US007789493B2

(12) United States Patent
Chung et al.

(10) Patent No.: US 7,789,493 B2
(45) Date of Patent: Sep. 7, 2010

(54) METHOD FOR MANUFACTURING PIEZOELECTRIC INK-JET PRINTHEAD

(75) Inventors: Jae-woo Chung, Suwon (KR); Jae-chang Lee, Kyungki-do (KR); Seung-mo Lim, Suwon (KR)

(73) Assignee: Samsung Electro-Mechanics Co., Ltd., Suwon-si, Gyunggi-do (KR)

( * ) Notice: Subject to any disclaimer, the term of this patent is extended or adjusted under 35 U.S.C. 154(b) by 902 days.

(21) Appl. No.: 11/540,541

(22) Filed: Oct. 2, 2006

(65) Prior Publication Data

US 2007/0019042 A1 Jan. 25, 2007

Related U.S. Application Data

(62) Division of application No. 10/321,604, filed on Dec. 18, 2002, now Pat. No. 7,121,650.

(30) Foreign Application Priority Data

Dec. 18, 2001 (KR) ..... 2001-80908

(51) Int. Cl.
*B41J 2/045* (2006.01)

(52) U.S. Cl. ..... 347/68; 347/70; 347/71

(58) Field of Classification Search ..... 347/68, 347/70, 71, 10, 11; 310/328
See application file for complete search history.

(56) References Cited

U.S. PATENT DOCUMENTS

| | | | | |
|---|---|---|---|---|
| 5,512,793 | A * | 4/1996 | Takeuchi et al. | 310/328 |
| 5,856,837 | A | 1/1999 | Kitahara et al. | |
| 5,992,974 | A | 11/1999 | Miyata | |
| 6,033,581 | A | 3/2000 | Kobayashi | |
| 6,193,360 | B1 * | 2/2001 | Nishiwaki et al. | 347/70 |
| 6,238,585 | B1 | 5/2001 | Miyata | |
| 6,341,847 | B1 | 1/2002 | Ohta et al. | |
| 6,411,017 | B1 | 6/2002 | Qui et al. | |
| 6,467,886 | B1 | 10/2002 | Takao et al. | |
| 6,508,539 | B2 | 1/2003 | Tanaka | |
| 6,554,408 | B1 | 4/2003 | Miki et al. | |
| 6,663,231 | B2 | 12/2003 | Lee et al. | |
| 6,874,871 | B2 | 4/2005 | Yun | |
| 7,121,650 | B2 * | 10/2006 | Chung et al. | 347/68 |
| 2001/0028378 | A1 | 10/2001 | Lee et al. | |
| 2002/0085065 | A1 | 7/2002 | Shimada et al. | |

FOREIGN PATENT DOCUMENTS

| | | |
|---|---|---|
| EP | 0 659 562 | 6/1995 |

(Continued)

*Primary Examiner*—Lam S Nguyen
(74) *Attorney, Agent, or Firm*—Lee & Morse, P.C.

(57) ABSTRACT

A piezoelectric ink-jet printhead and a method for manufacturing the same, wherein the piezoelectric ink-jet printhead is formed by stacking three monocrystalline silicon substrates on one another and adhering them to one another. The three substrates include an upper substrate, through which an ink supply hole is formed and a pressure chamber is formed on a bottom surface thereof; an intermediate substrate, in which an ink reservoir and a damper are formed; and a lower substrate, in which a nozzle is formed. A piezoelectric actuator is monolithically formed on the upper substrate. A restrictor, which connects the ink reservoir to the pressure chamber in flow communication, may be formed on the upper substrate or intermediate substrate.

37 Claims, 21 Drawing Sheets

FOREIGN PATENT DOCUMENTS

| | | |
|---|---|---|
| EP | 0 968 825 | 1/2000 |
| EP | 1 101 615 | 5/2001 |
| JP | 57-167272 | 10/1982 |
| JP | 6-206315 | 7/1994 |
| JP | 2000-079685 | 3/2000 |
| JP | 2000-94696 | 4/2000 |
| JP | 2001-179996 | 7/2001 |
| JP | 2001-287369 | 10/2001 |

* cited by examiner

METHOD FOR MANUFACTURING PIEZOELECTRIC INK-JET PRINTHEAD

CROSS REFERENCE TO RELATED APPLICATION

This is a divisional application based on application Ser. No. 10/321,604, filed Dec. 18, 2002, issued as U.S. Pat. No. 7,121,650, the entire contents of which is hereby incorporated by reference.

BACKGROUND OF THE INVENTION

1. Field of the Invention

The present invention relates to an ink-jet printhead. More particularly, the present invention relates to a piezoelectric ink-jet printhead made on a silicon substrate, and a method for manufacturing the same using a micromachining technology.

2. Description of the Related Art

In general, ink-jet printheads are devices for printing a predetermined color image by ejecting small droplets of printing ink at a desired position on a recording sheet. Ink ejection mechanisms of an ink-jet printer are generally categorized into two different types: an electro-thermal transducer type (bubble-jet type), in which a heat source is employed to form bubbles in ink thereby causing an ink droplet to be ejected, and an electro-mechanical transducer type, in which an ink droplet is ejected by a change in ink volume due to deformation of a piezoelectric element.

A typical structure of an ink-jet printhead using an electro-mechanical transducer is shown in FIG. 1. Referring to FIG. 1, an ink reservoir 2, a restrictor 3, an ink chamber 4, and a nozzle 5 for forming an ink passage are formed in a passage forming plate 1. A piezoelectric actuator 6 is provided on the passage forming plate 1. The ink reservoir 2 stores ink supplied from an ink container (not shown), and the restrictor 3 is a passage through which ink is supplied to the ink chamber 4 from the ink reservoir 2. The ink chamber 4 is filled with ink to be ejected. The volume of the ink chamber 4 is varied by driving the piezoelectric actuator 6, thereby a variation in pressure for ink ejection or in-flow is generated. The ink chamber 4 is also referred to as a pressure chamber.

The passage forming plate 1 is formed by cutting a plurality of thin plates formed of ceramics, metals, or plastics, forming a part of the ink passage, and then stacking the plurality of thin plates. The piezoelectric actuator 6 is provided above the ink chamber 4 and includes a piezoelectric thin plate stacked on an electrode for applying a voltage to the piezoelectric thin plate. As such, a portion of the passage forming plate 1 forming an upper wall of the ink chamber 4 serves as a vibration plate 1*a* to be deformed by the piezoelectric actuator 6.

The operation of a conventional piezoelectric ink-jet printhead having the above structure will now be described.

If the vibration plate 1*a* is deformed by driving the piezoelectric actuator 6, the volume of the ink chamber 4 is reduced. As a result, due to a variation in pressure in the ink chamber 4, ink in the ink chamber 4 is ejected through the nozzle 5. Subsequently, if the vibration plate 1*a* is restored to an original state by driving the piezoelectric actuator 6, the volume of the ink chamber 4 is increased. As a result, due to a variation in a pressure in the ink chamber 4, ink stored in the ink reservoir 2 is supplied to the ink chamber 4 through the restrictor 3.

A conventional piezoelectric ink-jet printhead is shown in FIG. 2. FIG. 3 illustrates a cross-sectional view of the conventional piezoelectric ink-jet printhead in a lengthwise direction of a pressure chamber of FIG. 2. FIG. 4 illustrates a portion of a cross-sectional view taken along line A-A' of FIG. 3.

Regarding to FIGS. 2 through 4, the conventional piezoelectric ink-jet printhead is formed by stacking a plurality of thin plates 11 to 16 and then adhering the plates to one another. More specifically, a first plate 11, on which a nozzle 11*a* through which ink is ejected, is formed and is the bottom of the printhead. A second plate 12, on which an ink reservoir 12*a* and an ink outlet 12*b* are formed, is stacked on the first plate 11. A third plate 13, on which an ink inlet 13*a* and an ink outlet 13*b* are formed, is stacked on the second plate 12. An ink supply hole 17, through which ink is supplied to the ink reservoir 12*a* from an ink container (not shown), is provided on the third plate 13. A fourth plate 14, on which an ink inlet 14*a* and an ink outlet 14*b* are formed, is stacked on the third plate 13. A fifth plate 15, on which a pressure chamber 15*a*, both ends of which are in flow communication with the ink inlet 14*a* and the ink outlet 14*b*, respectively, is formed and is stacked on the fourth plate 14. The ink inlets 13*a* and 14*a* serve as a passage through which ink is supplied to the pressure chamber 15*a* from the ink reservoir 12*a*. The ink outlets 12*b*, 13*b*, and 14*b* serve as a passage through which ink is ejected to the nozzle 11*a* from the pressure chamber 15*a*. A sixth plate 16 for closing the upper portion of the pressure chamber 15*a* is stacked on the fifth plate 15. A driving electrode 20 and a piezoelectric layer 21 are formed as a piezoelectric actuator on the sixth plate 16. Thus, the sixth plate 16 serves as a vibration plate operated by the piezoelectric actuator, and the volume of the pressure chamber 15*a* under the sixth plate 16 is varied according to the deformation of the vibration plate.

In general, the first, second, and third plates 11, 12, and 13 are formed by etching or press-working a metal thin plate, and the fourth, fifth, and sixth plates 14, 15, and 16 are formed by cutting a ceramic material having a thin plate shape. Meanwhile, the second plate 12 on which the ink reservoir 12*a* is formed, may be formed through injection molding or press-working a thin plastic material or an adhesive having a film shape, or through screen-printing an adhesive having a paste shape. The piezoelectric layer 21 formed on the sixth plate 16 is made by coating a ceramic material having a paste shape with a piezoelectric property and sintering the ceramic material.

As described above, in order to manufacture the conventional piezoelectric ink-jet printhead shown in FIG. 2, a plurality of metal plates and ceramic plates are separately processed using various processing methods, and then are stacked and adhered to one another using a predetermined adhesive. In the conventional printhead, however, the number of plates constituting the printhead is quite large, and thus the number of processes of aligning the plates is increased, thereby increasing an alignment error. If an alignment error occurs, ink is not smoothly supplied through the ink passage, thereby lowering ink ejection performance of the printhead. In particular, as high-density printheads have been manufactured in order to improve printing resolution, improvement of precision in the above-mentioned alignment process is needed, thereby increasing manufacturing costs.

However, the plurality of plates constituting the printhead are manufactured of different materials using different methods. Thus, a printhead manufacturing process becomes complicated, and it is difficult to adhere different materials to one another, thereby lowering production yield. Further, even though the plurality of plates may be precisely aligned and adhered to one another in the printhead manufacturing process, due to a difference in thermal expansion coefficients between different materials caused by a variation in ambient temperature when the printhead is used, an alignment error or deformation may still occur.

SUMMARY OF THE INVENTION

The present invention provides a piezoelectric ink-jet printhead, in which elements are integrated on three monocrystalline silicon substrates using a micromachining technology in order to realize a precise alignment, improve the adhering characteristics, and simplify a printhead manufacturing process, and a method for manufacturing the same.

According to an aspect of the present invention, there is provided a piezoelectric ink-jet printhead. The piezoelectric ink-jet printhead includes an upper substrate through which an ink supply hole, through which ink is supplied, is formed and a pressure chamber, which is filled with ink to be ejected and having two ends, is formed on a bottom of the upper substrate, an intermediate substrate on which an ink reservoir, which is connected to the ink supply hole and in which supplied ink is stored, is formed on a top of the intermediate substrate, and a damper is formed in a position which corresponds to one end of the pressure chamber, a lower substrate in which a nozzle, through which ink is to be ejected, is formed in a position which corresponds to the damper, and a piezoelectric actuator formed monolithically on the upper substrate and which provides a driving force for ejecting ink from the pressure chamber. A restrictor, which connects the other end of the pressure chamber to the ink reservoir, is formed on at least one side of the bottom surface of the upper substrate and the top surface of the intermediate substrate, and the lower substrate, the intermediate substrate, and the upper substrate are sequentially stacked on one another and are adhered to one another, the three substrates being formed of a monocrystalline silicon substrate. The upper substrate may have a thickness of about 100 to 200 micrometers, preferably, about 130 to 150 micrometers. The intermediate substrate may have a thickness of about 200 to 300 micrometers, and the lower substrate may have a thickness of about 100 to 200 micrometers.

In an embodiment of the present invention, a portion forming an upper wall of the pressure chamber of the upper substrate serves as a vibration plate that is deformed by driving the piezoelectric actuator. Preferably, the upper substrate is formed of a silicon-on-insulator (SOI) wafer having a structure in which a first silicon substrate, an intermediate oxide layer, and a second silicon substrate are sequentially stacked on one another, the pressure chamber is formed on the first silicon substrate, and the second silicon substrate serves as the vibration plate. Preferably, in the SOI wafer, the first silicon substrate is formed of monocrystalline silicon and has a thickness of about several tens to several hundreds of micrometers, the thickness of the intermediate oxide layer is from about several hundred angstroms to 2 micrometers, and the second silicon substrate is formed of monocrystalline silicon and has a thickness of from about several micrometers to several tens of micrometers.

It is also preferable that the pressure chamber is a plurality of pressure chambers arranged in two columns at both sides of the ink reservoir, and in this case, in order to divide the ink reservoir in a vertical direction, a barrier wall is formed in the reservoir in a lengthwise direction of the ink reservoir.

In addition, a silicon oxide layer may be formed between the upper substrate and the piezoelectric actuator. Here, the silicon oxide layer suppresses material diffusion and thermal stress between the upper substrate and the piezoelectric actuator.

It is also preferable that the piezoelectric actuator includes a lower electrode formed on the upper substrate, a piezoelectric layer formed on the lower electrode to be placed on an upper portion of the pressure chamber, and an upper electrode, which is formed on the piezoelectric layer and which applies a voltage to the piezoelectric layer. The lower electrode preferably has a two-layer structure in which a titanium (Ti) layer and a platinum (Pt) layer are stacked on each other, and the Ti layer and the Pt layer serve as a common electrode of the piezoelectric actuator and further serve as a diffusion barrier layer which prevents inter-diffusion between the upper substrate and the piezoelectric layer.

It is also preferable that the nozzle includes an orifice formed at a lower portion of the lower substrate, and an ink induction part that is formed at an upper portion of the lower substrate and connects the damper to the orifice in flow communication. It is also preferable that a sectional area of the ink induction part is gradually reduced from the damper to the orifice, and the ink induction part is formed in a quadrangular pyramidal shape.

The restrictor may have a rectangular section. Alternatively, the restrictor may have a T-shaped section and be formed deeply in a vertical direction from the top surface of the intermediate substrate.

According to another aspect of the present invention, there is provided a method for manufacturing a piezoelectric ink-jet printhead. The method includes preparing an upper substrate, an intermediate substrate, and a lower substrate, which are formed of a monocrystalline silicon substrate, micromachining the upper substrate, the intermediate substrate, and the lower substrate, respectively, to form an ink passage, stacking the lower substrate, the intermediate substrate, and the upper substrate, in each of which the ink passage has been formed, to adhere the lower substrate, the intermediate substrate, and the upper substrate to one another, and forming a piezoelectric actuator, which provides a driving force for ink ejection on the upper substrate. The upper substrate may be formed to have a thickness of about 100 to 200 micrometers, preferably, about 130 to 150 micrometers. The intermediate substrate may be formed to have a thickness of about 200 to 300 micrometers, and the lower substrate may be formed to have a thickness of about 100 to 200 micrometers.

The method may further include, before the forming of the ink passage, forming a base mark on each of the three substrates to align the three substrates during the adhering of the three substrates, and before the forming of the piezoelectric actuator, forming a silicon oxide layer on the upper substrate.

Preferably, the forming of the ink passage includes forming a pressure chamber having two ends filled with ink to be ejected and an ink supply hole through which ink is supplied on a bottom of the upper substrate, forming a restrictor connected to one end of the pressure chamber, at least on one side of a bottom surface of the upper substrate, and a top surface of the intermediate substrate, forming a damper, connected to the other end of the pressure chamber, in the intermediate substrate, forming an ink reservoir, an end of which is connected to the ink supply hole and a side of which is connected to the restrictor, on the top of the intermediate substrate, and forming a nozzle, connected to the damper in flow communication, in the lower substrate.

Preferably, during the forming of the pressure chamber and the ink supply hole, a silicon-on-insulator (SOI) wafer having a structure in which a first silicon substrate, an intermediate oxide layer, and a second silicon substrate are sequentially stacked on one another, is used for the upper substrate, and the first silicon substrate is etched using the intermediate oxide layer as an etch stop layer, thereby forming the pressure chamber and the ink supply hole. Preferably, in the SOI wafer, the second silicon substrate is formed of monocrystalline silicon to have a thickness of from about several micrometers to several tens of micrometers.

In the forming of the restrictor, the bottom surface of the upper substrate or the top surface of the intermediate substrate are dry or wet etched. Meanwhile, the restrictor may be formed by forming a portion of the restrictor on the bottom of the upper substrate and forming another portion of the restrictor on the top of the intermediate substrate.

Also, in the forming of the restrictor, the top surface of the intermediate substrate may be formed to a predetermined depth through dry etching using inductively coupled plasma (ICP), thereby forming the restrictor having a T-shaped section. In this particular arrangement, the forming of the restrictor and the forming of the ink reservoir are simultaneously performed.

Preferably, forming the damper includes forming a hole having a predetermined depth connected to the other end of the pressure chamber, on the top of the intermediate substrate, and perforating the hole, thereby forming the damper connected to the other end of the pressure chamber. Forming the hole may be performed through sand blasting or dry etching using inductively coupled plasma (ICP), and the perforating the hole may be performed through dry etching using ICP. Preferably, perforating the hole is performed simultaneously with the forming of the ink reservoir. The damper may be formed to have a circular shape or a polygonal shape.

Preferably, during the forming of the ink reservoir, the top surface of the intermediate substrate is dry etched to a predetermined depth to form the ink reservoir.

Preferably, forming of the nozzle comprises etching the top surface of the lower substrate to a predetermined depth to form an ink induction part connected to the damper in flow communication, and etching the bottom surface of the lower substrate to form an orifice connected to the ink induction part in flow communication.

Preferably, during the forming of the ink induction part, the lower substrate is anisotropically wet etched using a silicon substrate having a crystalline face in a direction (100) as the lower substrate, thereby forming the ink induction part having a quadrangular pyramidal shape. In another embodiment of the present invention, the ink induction part may be formed to have a conical shape.

Preferably, during the adhering of the substrates, the stacking of the three substrates is performed using a mask aligner, and the adhering of the three substrates is performed using a silicon direct bonding (SDB) method. Also preferably, in order to improve an adhering property of the three substrates, the three substrates are adhered to one another in a state where silicon oxide layers are formed at least on a bottom surface of the upper substrate and on a top surface of the lower substrate.

Preferably, forming the piezoelectric actuator includes sequentially stacking a Ti layer and a Pt layer on the upper substrate to form a lower electrode, forming a piezoelectric layer on the lower electrode, and forming an upper electrode on the piezoelectric layer. The forming of the piezoelectric layer may further include, after forming the upper electrode, dicing the adhered three substrates in units of a chip, and applying an electric field to the piezoelectric layer of the piezoelectric actuator to generate piezoelectric characteristics.

During the forming of the piezoelectric layer, a piezoelectric material in a paste state is coated on the lower electrode in a position that corresponds to the pressure chamber and is then sintered, thereby forming the piezoelectric layer, and the coating of the piezoelectric material is performed through screen-printing. Preferably, while the piezoelectric material is sintered, an oxide layer is formed on an inner wall of the ink passage formed on the three substrates. The sintering may be performed before the dicing or after the dicing.

According to another aspect of the present invention, there is provided a piezoelectric ink-jet printhead. The piezoelectric ink-jet printhead includes an ink reservoir in which ink is stored, the ink being supplied from an ink container, a pressure chamber filled with ink to be ejected, a restrictor which connects the ink reservoir to the pressure chamber in flow communication, a nozzle through which ink is ejected from the pressure chamber, and a piezoelectric actuator which provides a driving force for ejecting ink to the pressure chamber. The restrictor has a T-shaped section and is formed to be longer in a vertical direction.

According to the above-mentioned present invention, elements constituting an ink passage, such as an ink reservoir and the pressure chamber, are formed on three silicon substrates using a silicon micromachining technology, thereby the elements can be precisely and easily formed to a fine size on each of the three substrates. In addition, since the three substrates are formed of silicon, an adhering property to one another is high. Further, the number of substrates is reduced as compared with conventional devices, thereby a manufacturing process is simplified, and an alignment error is reduced.

BRIEF DESCRIPTION OF THE DRAWINGS

The above and other aspects, features and advantages of the present invention will become readily apparent to those of ordinary skill in the art by describing in detail preferred embodiments thereof with reference to the attached drawings in which.

DETAILED DESCRIPTION OF THE INVENTION

Figure 1:
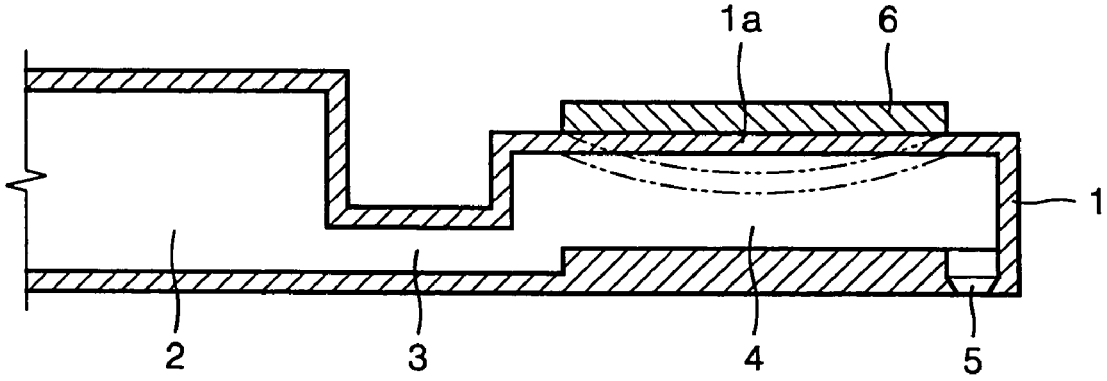
FIG. 1 (PRIOR ART)
FIG. 1 illustrates a cross-sectional view of a typical structure of a conventional piezoelectric ink-jet printhead.
Figure 2:
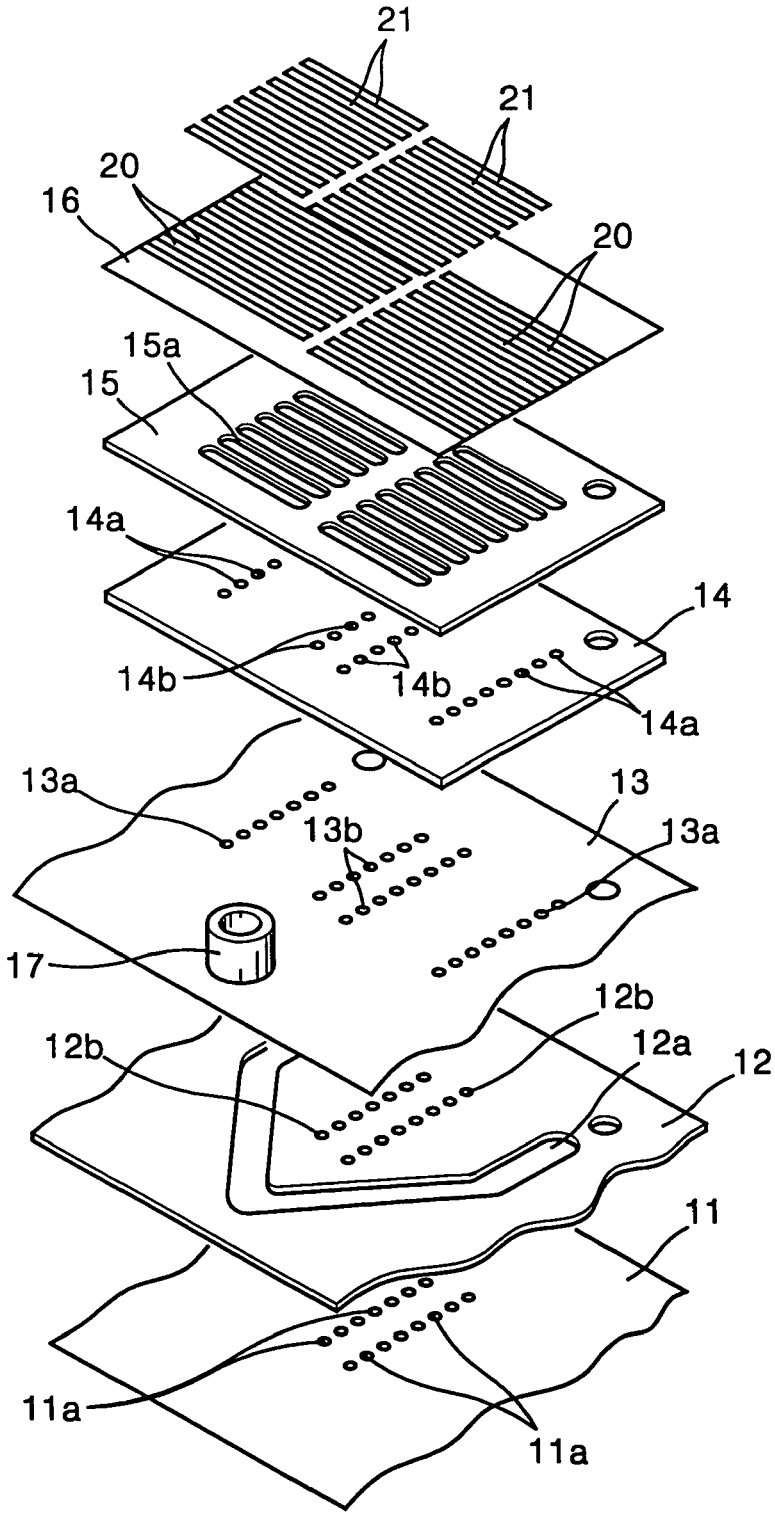
FIG. 2 (PRIOR ART)
FIG. 2 illustrates an exploded perspective view of a conventional piezoelectric ink-jet printhead.
Figure 3:
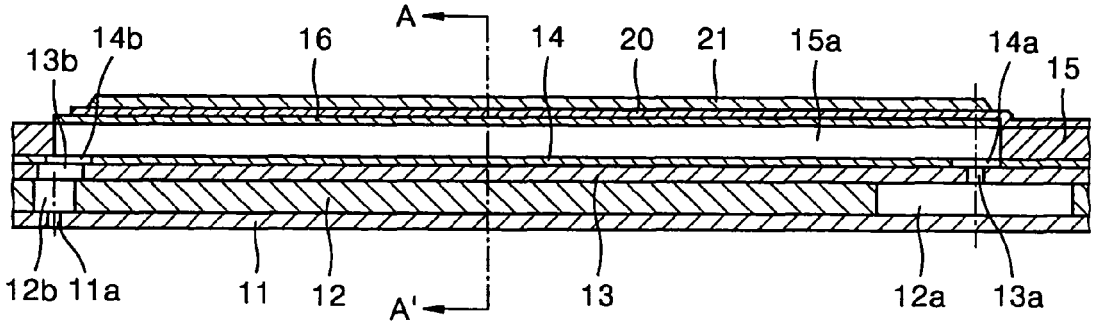
FIG. 3 (PRIOR ART)
FIG. 3 illustrates a cross-sectional view of the conventional piezoelectric ink-jet printhead in a lengthwise direction of a pressure chamber of FIG. 2.
Figure 4:
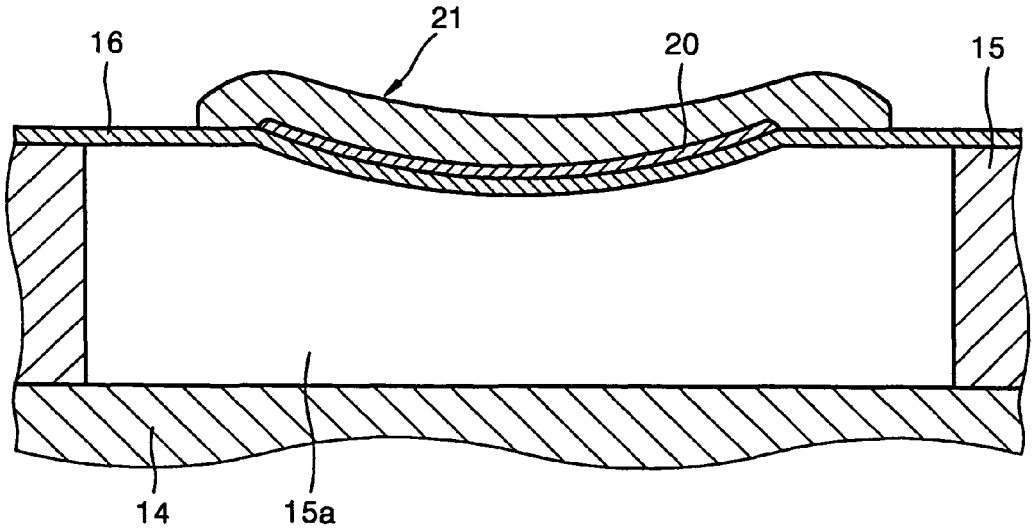
FIG. 4 (PRIOR ART)
FIG. 4 illustrates a portion of a cross-sectional view taken along line A-A' of FIG. 3.

Korean Patent Application No. 2001-80908, filed Dec. 18, 2001, and entitled: "Piezoelectric Ink-Jet Printhead and Method for Manufacturing the Same," is incorporated by reference herein in its entirety.

The present invention will now be described more fully with reference to the accompanying drawings, in which preferred embodiments of the present invention are shown. This invention may, however, be embodied in many different forms and should not be construed as being limited to the embodiments set forth herein. Rather, these embodiments are provided so that this disclosure will be thorough and complete, and will fully convey the concept of the present invention to those of ordinary skill in the art. In the drawings, like reference numerals denote elements having the same functions, and the size and thickness of an element may be exaggerated for clarity. Further, it will be understood that when a layer is referred to as being "on" another layer or substrate, it may be directly on the other layer or substrate, or intervening layers may also be present.

Figure 5:
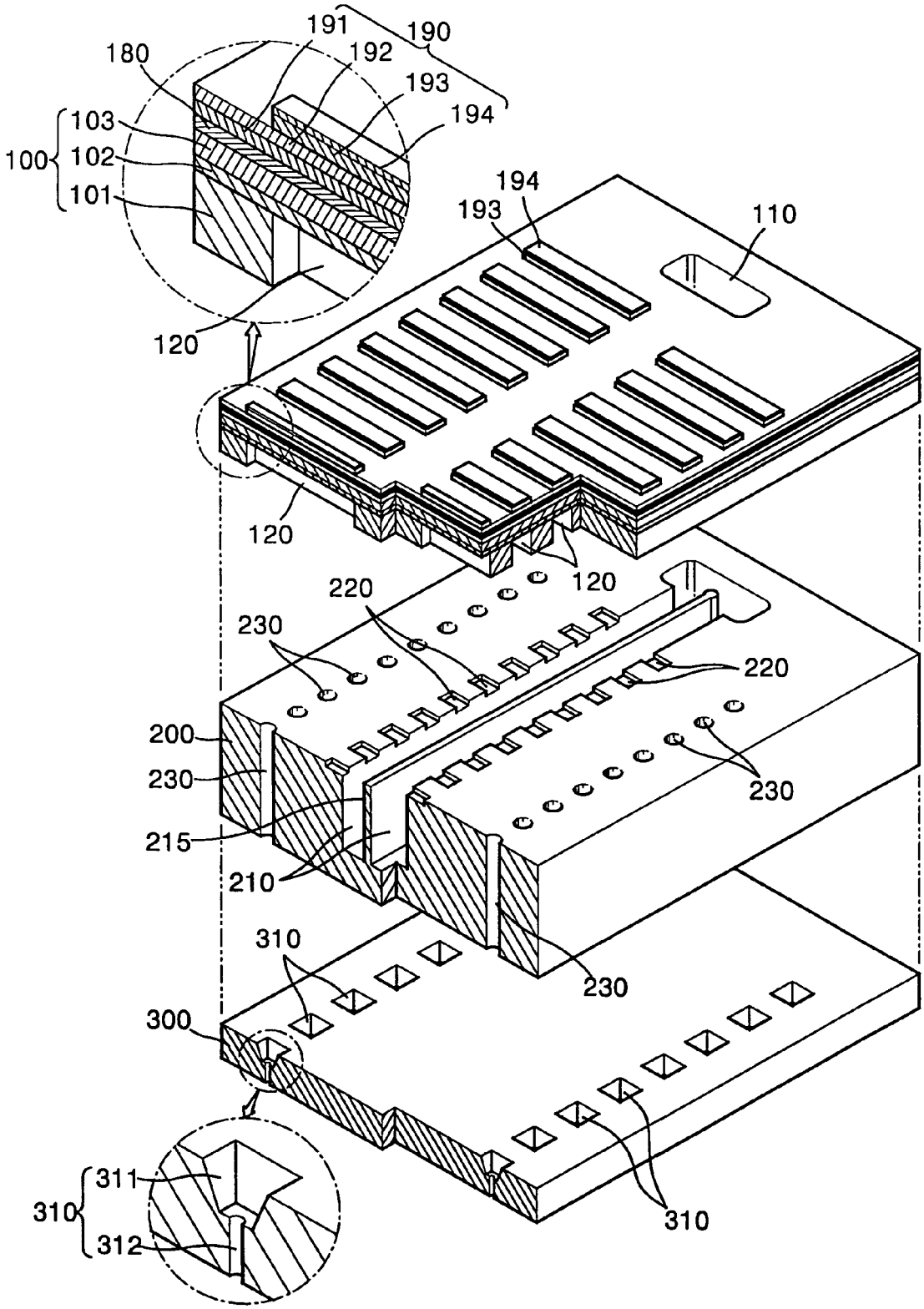
FIG. 5 illustrates a sectional exploded perspective view of a piezoelectric ink-jet printhead according to an embodiment of the present invention.
Figure 6A:
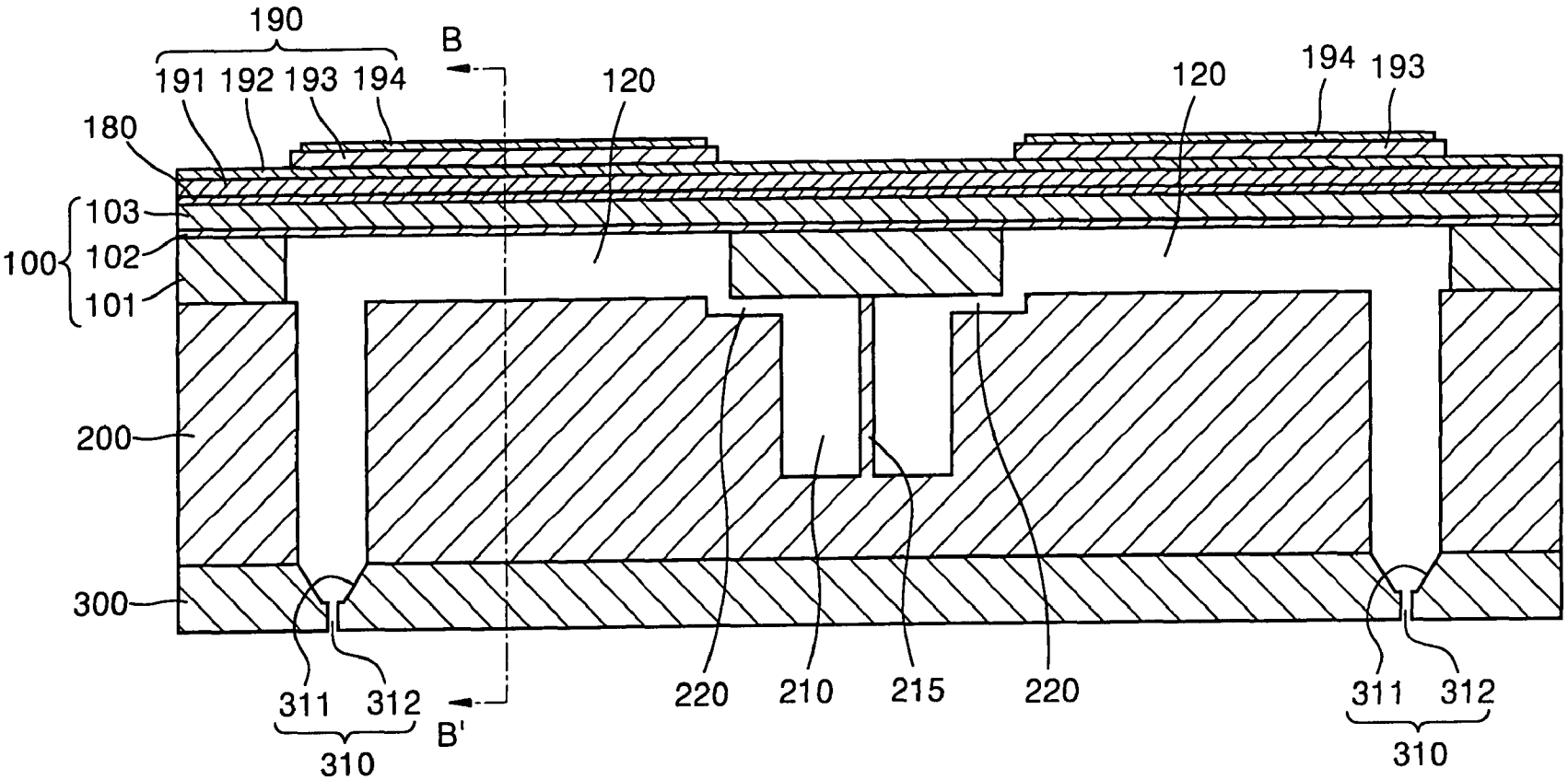
FIG. 6A illustrates a cross-sectional view of the embodiment of the piezoelectric ink-jet printhead in a lengthwise direction of a pressure chamber of FIG. 5.
Figure 6B:
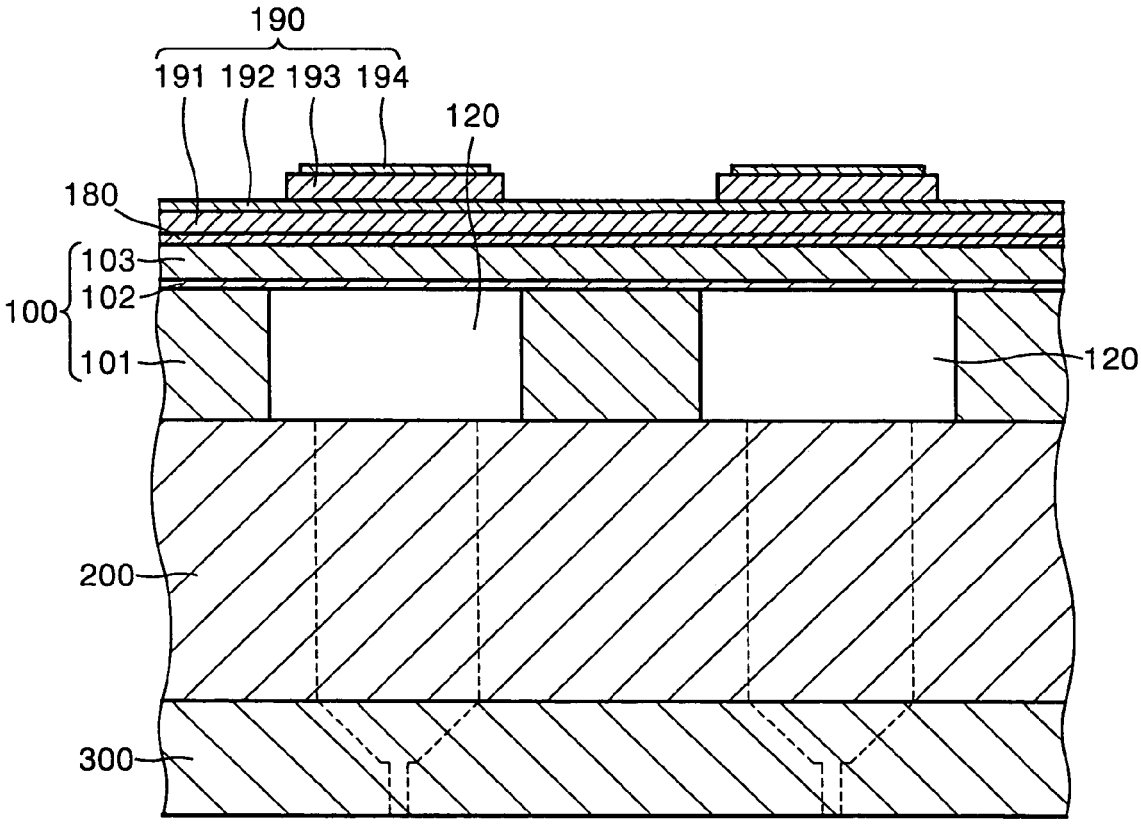
FIG. 6B illustrates an enlarged cross-sectional view taken along line B-B' of FIG. 6A.

FIG. 5 illustrates a sectional exploded perspective view of a piezoelectric ink-jet printhead according to an embodiment of the present invention. FIG. 6A illustrates a cross-sectional view of the embodiment of the piezoelectric ink-jet printhead shown in FIG. 5 in a lengthwise direction of a pressure chamber. FIG. 6B illustrates an enlarged cross-sectional view taken along line B-B' of FIG. 6A.

Referring to FIGS. 5, 6A, and 6B, stacking three substrates 100, 200, and 300 on one another and adhering them to one another forms a piezoelectric ink-jet printhead according to an embodiment of the present invention. Elements constituting an ink passage are formed on each of the three substrates 100, 200, and 300, and a piezoelectric actuator 190 for generating a driving force for ink ejection is provided on the upper substrate 100. In particular, the three substrates 100, 200, and 300 are formed of a monocrystalline silicon wafer. As such, the elements constituting an ink passage can be precisely and easily formed to a fine size on each of the three substrates 100, 200, and 300, using a micromachining technology, such as photolithography or etching.

The ink passage includes an ink supply hole 110 through which ink is supplied from an ink container (not shown), an ink reservoir 210 in which ink that has flowed through the ink supply hole 110 is stored, a restrictor 220 for supplying ink to a pressure chamber 120 from the ink reservoir 210, the pressure chamber 120 which is to be filled with ink to be ejected for generating a variation in pressure for ink ejection, and a nozzle 310 through which ink is ejected. In addition, a damper 230 that concentrates energy generated in the pressure chamber 120 by the piezoelectric actuator 190 and alleviates a rapid variation in pressure, may be formed between the pressure chamber 120 and the nozzle 310. As described above, the elements constituting the ink passage are allocated to each of the three substrates 100, 200, and 300 and are arranged on each of the three substrates 100, 200, and 300.

The pressure chamber 120 having a predetermined depth is formed on the bottom of the upper substrate 100. The ink supply hole 110, a through hole, is formed at one side of the upper substrate 100. Preferably, the pressure chamber 120 is formed in the shape of a cuboid longer in a flow direction of ink and is a plurality of pressure chambers arranged in two columns at both sides of the ink reservoir 210 formed on the intermediate substrate 200. Alternatively, the pressure chamber 120 may be a plurality of pressure chambers arranged only in one column at one side of the ink reservoir 210.

The upper substrate 100 is formed of a monocrystalline silicon wafer used in manufacturing integrated circuits (ICs). Preferably, the upper substrate 100 is formed of a silicon-on-insulator (SOI) wafer. In general, the SOI wafer has a structure in which a first silicon substrate 101, an intermediate oxide layer 102 formed on the first silicon substrate 101, and a second silicon substrate 103 adhered onto the intermediate oxide layer 102 are sequentially stacked. The first silicon substrate 101 is formed of monocrystalline silicon and has a thickness of about several tens to several hundred micrometers. Oxidizing the surface of the first silicon substrate 101 may form the intermediate oxide layer 102, and the thickness of the intermediate oxide layer 102 is from about several hundred angstroms to 2 μm. The second silicon substrate 103 is also formed of monocrystalline silicon, and a thickness thereof is from about several micrometers to several tens of micrometers.

The reason the SOI wafer is used for the upper substrate 100 is so that the height of the pressure chamber 120 can be precisely adjusted. That is, since the intermediate oxide layer 102 forming an intermediate layer of the SOI wafer serves as an etch stop layer, if the thickness of the first silicon substrate 101 is determined, the height of the pressure chamber 120 is correspondingly determined. The second silicon substrate 103 forming an upper wall of the pressure chamber 120, which is deformed by the piezoelectric actuator 190, thereby serves as a vibration plate for varying the volume of the pressure chamber 120. The thickness of the vibration plate is also determined by the thickness of the second silicon substrate 103. This will be described in detail later.

The piezoelectric actuator 190 is formed monolithically on the upper substrate 100. A silicon oxide layer 180 is formed between the upper substrate 100 and the piezoelectric actuator 190. The silicon oxide layer 180 serves as an insulating layer, suppresses material diffusion between the upper substrate 100 and the piezoelectric actuator 190, and adjusts a thermal stress. The piezoelectric actuator 190 includes lower electrodes 191 and 192, which serve as a common electrode; a piezoelectric layer 193, which is deformed by an applied voltage; and an upper electrode 194, which serves as a driving electrode. The lower electrodes 191 and 192 are formed on the entire surface of the silicon oxide layer 180 and preferably, are formed of two thin metal layers, such as a titanium (Ti) layer 191 and a platinum (Pt) layer 192. The Ti layer 191 and the Pt layer 192 serve as a common electrode and further serve as a diffusion barrier layer which prevents inter-diffusion between the piezoelectric layer 193 formed thereon and the upper substrate 100 formed thereunder. The piezoelectric layer 193 is formed on the lower electrodes 191 and 192 and is placed on an upper portion of the pressure chamber 120. The piezoelectric layer 193 is deformed by an applied voltage and serves to deform the second silicon substrate 103, i.e., the vibration plate, of the upper substrate 100 forming the upper wall of the pressure chamber 120. The upper electrode 194 is formed on the piezoelectric layer 193 and serves as a driving electrode for applying a voltage to the piezoelectric layer 193.

The ink reservoir 210 connected to the ink supply hole 110 is formed to a predetermined depth and to be longer on the top of the intermediate substrate 200. The restrictor 220 for connecting the ink reservoir 210 to one end of the pressure chamber 120 is formed to be shallower. The damper 230 is formed vertically in the intermediate substrate 200 in a position that corresponds to the other end of the pressure chamber 120. The section of the damper 230 may be formed in a circular shape or a polygonal shape. As described above, if the pressure chambers 120 are arranged in two columns at both sides of the ink reservoir 210, the ink reservoir 210 is divided into two portions by forming a barrier wall 215 in the ink reservoir 210 in a lengthwise direction of the ink reservoir 210. This is preferable to supply ink smoothly and to prevent cross talk between the pressure chambers 120 disposed at both sides of the ink reservoir 210. The restrictor 220 serves as a passage through which ink is supplied to the pressure chamber 120 from the ink reservoir 120 and further serves to prevent ink from flowing backward into the ink reservoir 120 from the pressure chamber 120 when ink is ejected. In order to prevent the backward flow of ink, the sectional area of the restrictor 220 is much smaller than the sectional areas of the pressure chamber 120 and the damper 230, and is within a range in which the amount of ink is properly supplied to the pressure chamber 120.

Meanwhile, the restrictor 220 has been shown and described as formed on the top of the intermediate substrate 200. However, the restrictor 220, although not illustrated as such, may be formed on the bottom of the upper substrate 100, or a portion of the restrictor 220 may be formed on the bottom of the upper substrate 100 and another portion of the restrictor 220 may be formed on the top of the intermediate substrate 200. In the latter case, by adhering the upper substrate 100 to the intermediate substrate 200 the restrictor 220 results in a complete arrangement.

The nozzle 310 is formed in a position, which corresponds to the damper 230, on the lower substrate 300. The nozzle 310 includes an orifice 312, which is formed at the lower portion of the lower substrate 300 and through which ink is ejected, and an ink induction part 311 which is formed at the upper portion of the lower substrate 300, connects the damper 230 to the orifice 312 in flow communication, and pressurizes and induces ink toward the orifice 312 from the damper 230. The orifice 312 is preferably formed in a vertical hole having a predetermined diameter. The ink induction part 311 is preferably formed in a quadrangular pyramidal shape in which the area of the ink induction part 311 is gradually reduced from the damper 230 to the orifice 312. Meanwhile, the ink induction part 311 may be formed in a conic shape. However, as will be described in greater detail later, it is preferable that the ink induction part 311 having a quadrangular pyramidal shape is formed on the lower substrate 300 formed of a monocrystalline silicon wafer.

As described previously, the three substrates 100, 200, and 300 are stacked on one another and are adhered to one another, thereby forming the piezoelectric ink-jet printhead according to the present invention. The ink passage in which the ink supply hole 110, the ink reservoir 210, the restrictor 220, the pressure chamber 120, the damper 230, and the nozzle 310 are connected in sequence, is formed in the three substrates 100, 200, and 300.

The operation of the piezoelectric ink-jet printhead according to the present invention having the above structure will now be described.

Ink supplied to the ink reservoir 210 through the ink supply hole 110 from an ink container (not shown) is supplied to the pressure chamber 120 through the restrictor 220. If the pressure chamber 120 is filled with ink and a voltage is applied to the piezoelectric layer 193 through the upper electrode 194 of the piezoelectric actuator 190, the piezoelectric layer 193 is deformed. As such, the second silicon substrate 103 of the upper substrate 100, which serves as a vibration plate, is bent downwardly. Due to the flexural deformation of the second silicon substrate 103, the volume of the pressure chamber 120 is reduced, and due to an increase in pressure in the pressure chamber 120, ink in the pressure chamber 120 is ejected through the nozzle 310 via the damper 230. In this case, increasing pressure in the pressure chamber 120 is concentrated toward the damper 230 having a sectional area wider than the sectional area of the restrictor 220. Accordingly, most of the ink in the pressure chamber 120 is discharged to the damper 230 and is prevented ink from flowing backward into the ink reservoir 210 through the restrictor 220. Ink, which arrives at the nozzle 310 through the damper 230, is pressured by the ink induction part 311, and then the ink is ejected through the orifice 312.

Subsequently, if the voltage applied to the piezoelectric layer 193 of the piezoelectric actuator 190 is cut off, the piezoelectric layer 193 is restored to an original state, thereby restoring the second silicon substrate 103 which serves as a vibration plate to an original state, and increasing the volume of the pressure chamber 120. Due to a decrease in pressure in the pressure chamber 120, ink stored in the ink reservoir 210 flows to the pressure chamber 120 through the restrictor 220, thereby refilling the pressure chamber 120 with ink.

Figure 7:
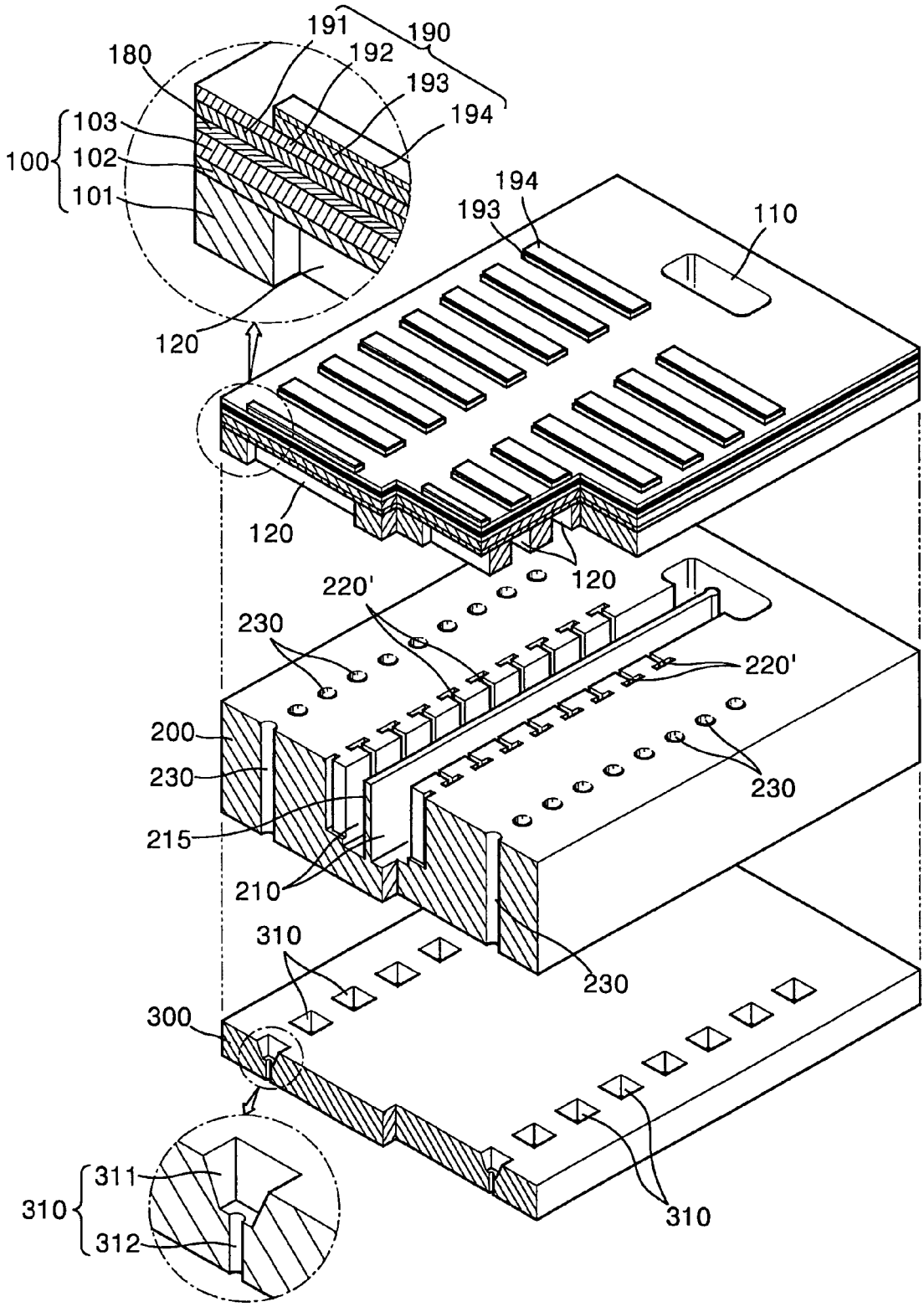
FIG. 7 illustrates an exploded perspective view of a piezoelectric ink-jet printhead having a T-shaped restrictor according to another embodiment of the present invention.

FIG. 7 illustrates a piezoelectric ink-jet printhead having a T-shaped restrictor according to an alternate embodiment of the present invention. Here, like reference numerals in FIG. 5 denote elements having the same functions.

As shown in FIG. 7, except for a restrictor 220', the present embodiment is the same as the embodiment of FIG. 5. Thus, descriptions of like elements will be omitted, and only differences will be described below.

Referring to FIG. 7, the restrictor 220' for supplying ink to the pressure chamber 120 from the ink reservoir 210 has a T-shaped section and is formed deeply in a vertical direction from the top surface of the intermediate substrate 200. The depth of the restrictor 220' may be the same as or smaller than the depth of the ink reservoir 210. Similarly, the restrictor 220' has a greater depth as compared with the restrictor 220 of FIG. 5, and thus, the entire volume is increased more than the volume of the restrictor 220 of FIG. 5. Thus, a variation in volume between the pressure chamber 120 and the restrictor 220' is reduced. According to the restrictor 220', flow resistance of ink supplied to the pressure chamber 120 from the ink reservoir 210 is reduced, and a pressure loss in the supplying of ink through the restrictor 220' is reduced. As such, quantity of flow passing the restrictor 220' is increased such that ink is more smoothly and quickly refilled in the pressure chamber 120. Consequently, even when the ink-jet printhead is driven in a high frequency region, uniform ink ejection volume and ink ejection speed can be obtained.

Additionally, as described above, the restrictor 220' having the T-shaped section may be also adopted in ink-jet printheads having different structures as well as in the piezoelectric ink-jet printhead having the structure of FIG. 7.

Hereinafter, a method for manufacturing the piezoelectric ink-jet printhead according to the present invention will be described with reference to the accompanying drawings. The method will be described on the basis of the piezoelectric ink-jet printhead having the structure of FIG. 5. A method for manufacturing the piezoelectric ink-jet printhead having the structure of FIG. 7 will be described only with respect to the formation of a restrictor.

In the method of an embodiment of the present invention, three substrates, such as an upper substrate, an intermediate substrate, and a lower substrate, in which elements for forming an ink passage are formed, are manufactured respectively, and then the three substrates are stacked on one another and are adhered to one another, and then, a piezoelectric actuator is formed on the upper substrate, thereby completing a piezoelectric ink-jet printhead according to the present invention. Steps of manufacturing the upper, intermediate, and lower substrates may be performed regardless of the order of the substrates. That is, the lower substrate or intermediate substrate may be first manufactured, or two or all three substrates may be simultaneously manufactured. For convenience, the steps of manufacturing the upper substrate, the intermediate substrate, and the lower substrate will be sequentially described below. As described previously, the restrictor may be formed on the bottom of the upper substrate or on the top of the intermediate substrate, or a portion of the restrictor may be formed both on the bottom of the upper substrate and on the top of the intermediate substrate. However, to avoid complexity of descriptions thereof, the following description illustrates that the restrictor is formed on the top of the intermediate substrate.

FIGS. 8A through 8E illustrates cross-sectional views of stages in the formation of a base mark on an upper substrate in a method for manufacturing the piezoelectric ink-jet printhead according to an embodiment of the present invention.

Figure 8A:
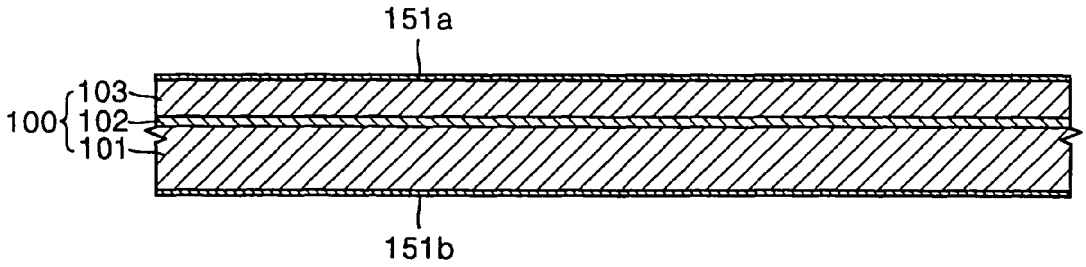
FIGS. 8A through 8E illustrate cross-sectional views of stages in the formation of a base mark on an upper substrate in a method for manufacturing the piezoelectric ink-jet printhead according to an embodiment of the present invention.

Referring to FIG. 8A, in the present embodiment, the upper substrate 100 is formed of a monocrystalline silicon substrate. This material is selected because a silicon wafer that is widely used to manufacture semiconductor devices can be used without any changes, and thus is effective in mass production. The thickness of the upper substrate 100 is about 100 to 200 μm, preferably, about 130 to 150 μm and may be properly determined by the height of the pressure chamber (120 of FIG. 5) formed on the bottom of the upper substrate 100. It is preferable that a SOI wafer is used for the upper substrate 100, so that the height of the pressure chamber (120 of FIG. 5) can be precisely formed. The SOI wafer, as described previously, has a structure in which the first silicon substrate 101, the intermediate oxide layer 102 formed on the first silicon substrate 101, and the second silicon substrate 103 adhered onto the intermediate oxide layer 102 are sequentially stacked. In particular, the second silicon substrate 103 has a thickness of several micrometers or several tens of micrometers in order to optimize the thickness of the vibration plate.

If the upper substrate 100 is put in an oxidation furnace and wet or dry oxidized, the top and bottom surfaces of the upper substrate 100 are oxidized, thereby forming silicon oxide layers 151*a* and 151*b*.

Figure 8B:
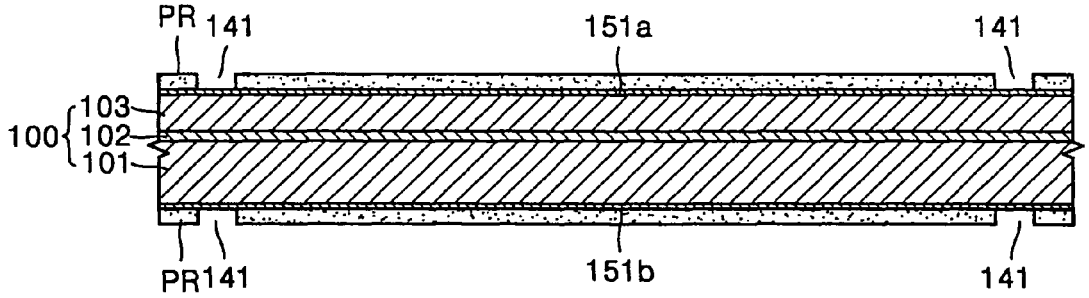

Next, a photoresist (PR) is coated on the surface of the silicon oxide layers 151*a* and 151*b*, which are formed on the top and bottom of the upper substrate 100, respectively, as shown in FIG. 8B. Subsequently, the coated photoresist (PR) is developed, thereby forming an opening 141 for forming a base mark in the vicinity of an edge of the upper substrate 100.

Figure 8C:
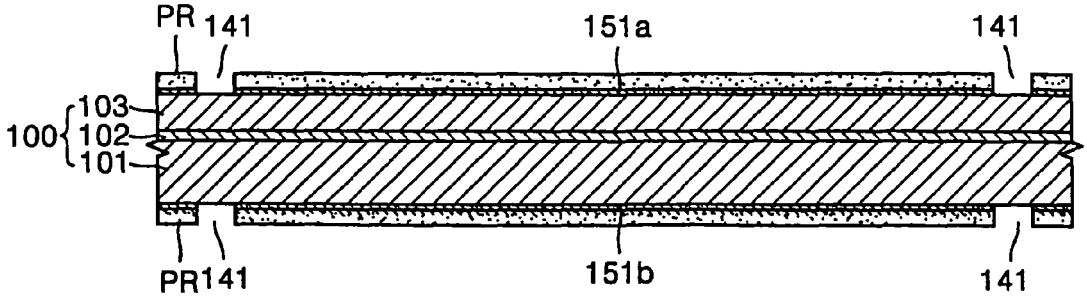

Next, a portion of the silicon oxide layers 151*a* and 151*b* exposed through the opening 141 is wet etched using the PR as an etch mask and removed, thereby partially exposing the upper substrate 100, as shown in FIG. 8C.

Figure 8D:
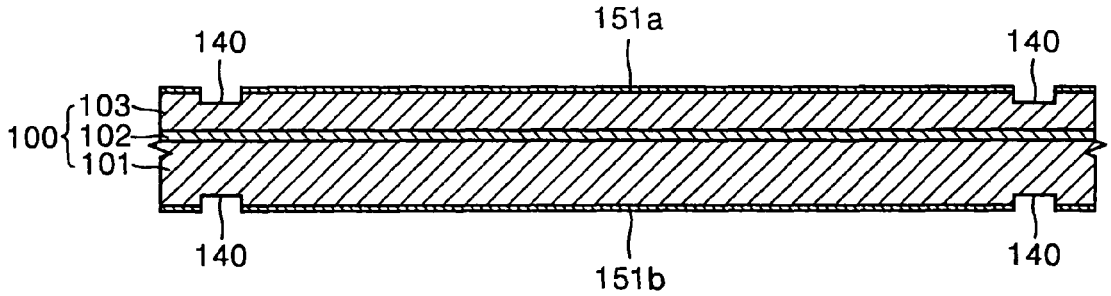

Then, the PR is stripped, and the exposed portion of the upper substrate 100 is wet etched to a predetermined depth using the silicon oxide layers 151*a* and 151*b* as an etching mask, thereby forming a base mark 140, as shown in FIG. 8D. In this case, when the upper substrate 100 is wet etched, tetramethyl ammonium hydroxide (TMAH) or KOH, for example, may be used as a silicon etchant.

Figure 8E:
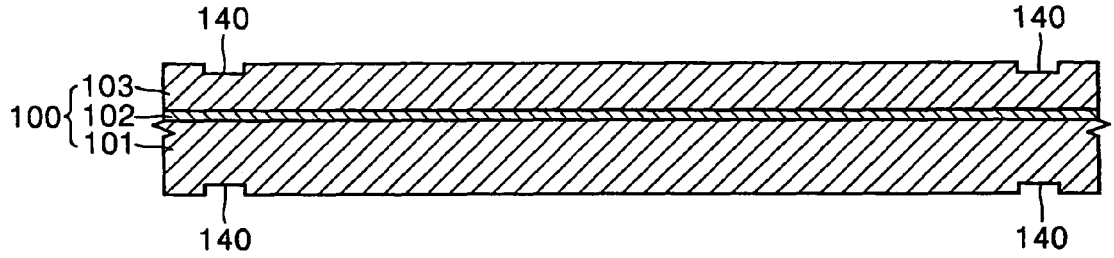

After the base mark 140 is formed, the remaining silicon oxide layers 151*a* and 151*b* are removed through wet etching. This step is performed to clean foreign particles, such as by-products from the performance of the above steps, simultaneously with the removal of the silicon oxide layers 151*a* and 151*b*. Accordingly, the upper substrate 100 in which the base mark 140 is formed in the vicinity of the edge of the top and bottom surfaces of the upper substrate 100 is prepared, as shown in FIG. 8E.

When the upper substrate 100, an intermediate substrate and a lower substrate, which will be described later, are stacked on one another and are adhered to one another, the base mark 140 is used to precisely align the upper substrate 100, the intermediate substrate, and the lower substrate. Thus, in the case of the upper substrate 100, the base mark 140 may be formed only on the bottom of the upper substrate 100. In addition, when another alignment method or apparatus is used, the base mark 140 may not be needed, and in that case, the above steps may be omitted.

FIGS. 9A through 9G illustrate cross-sectional views of stages in the formation of the pressure chamber on the upper substrate.

Figure 9A:
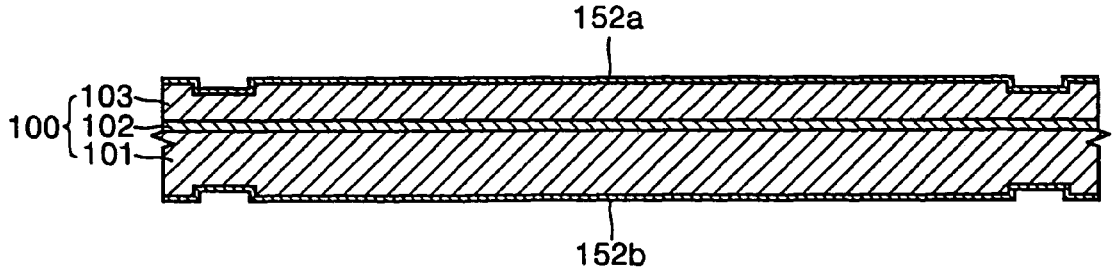
FIGS. 9A through 9G illustrate cross-sectional views of stages in the formation of the pressure chamber on the upper substrate.

The upper substrate 100 is put in the oxidation furnace and is wet or dry oxidized, thereby forming silicon oxide layers 152*a* and 152*b* on the top and bottom of the upper substrate 100, respectively, as shown in FIG. 9A. Alternatively, the silicon oxide layer 152*b* may be formed only on the bottom of the upper substrate 100.

Figure 9B:
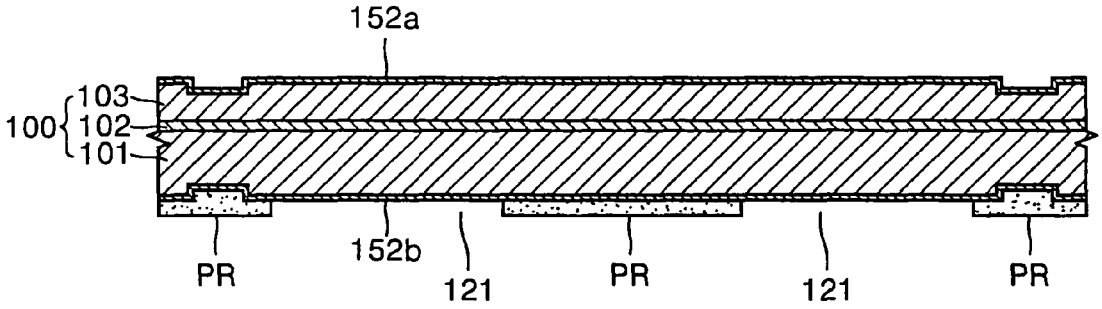

Next, a photoresist (PR) is coated on the surface of the silicon oxide layer 152*b* formed on the bottom of the upper substrate 100, as shown in FIG. 9B. Subsequently, the coated photoresist (PR) is developed, thereby forming an opening 121 for forming a pressure chamber having a predetermined depth on the bottom of the upper substrate 100.

Figure 9C:
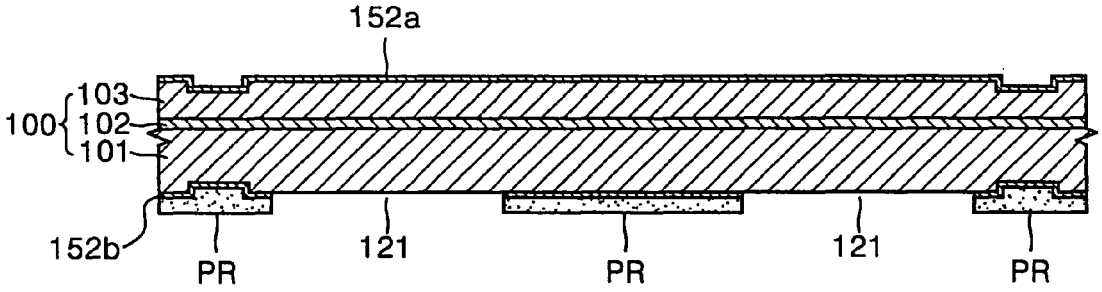

Then, a portion of the silicon oxide layer 152*b* exposed through the opening 121 is removed through a dry etching, such as reactive ion etching (RIE), using the photoresist (PR) as an etching mask, thereby partially exposing the bottom surface of the upper substrate 100, as shown in FIG. 9C. In this case, the silicon oxide layer 152*b* exposed through the opening 121 may also be removed through wet etching.

Figure 9D:
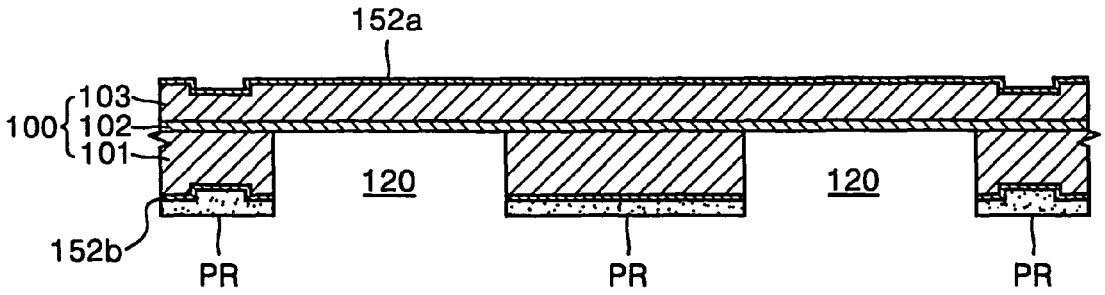

Next, the exposed portion of the upper substrate 100 is etched to a predetermined depth using the photoresist (PR) as an etching mask, thereby forming a pressure chamber 120, as shown in FIG. 9D. In this case, a dry etch process of the upper substrate 100 may be performed using inductively coupled plasma (ICP). As shown in FIG. 9D, if a SOI wafer is used for the upper substrate 100, an intermediate oxide layer 102 formed of a SOI wafer serves as an etch stop layer, and thus in this step, only the first silicon substrate 101 is etched. Thus, the thickness of the first silicon substrate 101 is used to precisely control the height of the pressure chamber 120. The thickness of the first silicon substrate 101 may be easily adjusted during a wafer polishing process. Meanwhile, the second silicon substrate 103 for forming an upper wall of the pressure chamber 120 serves as a vibration plate, as described previously, and the thickness of the second silicon substrate 103 may similarly be easily adjusted during the wafer polishing process.

Figure 9E:
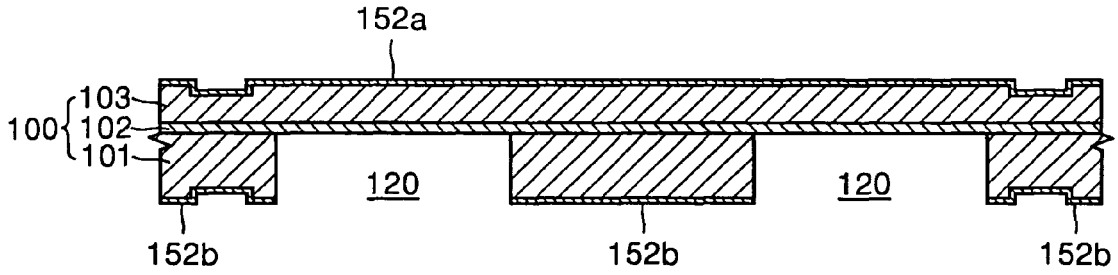

After the pressure chamber 120 is formed, if the photoresist (PR) is stripped, the upper substrate 100 is prepared, as shown in FIG. 9E. However, in this state, foreign particles, such as by-products or polymer from in the above-mentioned wet etching, or RIE, or dry etch process using ICP, may be attached to the surface of the upper substrate 100. Thus, in order to remove these foreign particles, it is preferable that the entire surface of the upper substrate 100 is cleaned using sulfuric acid solution or TMAH. In this case, the remaining silicon oxide layers 152*a* and 152*b* are removed through wet etching, and part of the intermediate oxide layer 102 of the upper substrate 100, i.e., a portion forming the upper wall of the pressure chamber 120, is also removed.

Figure 9F:
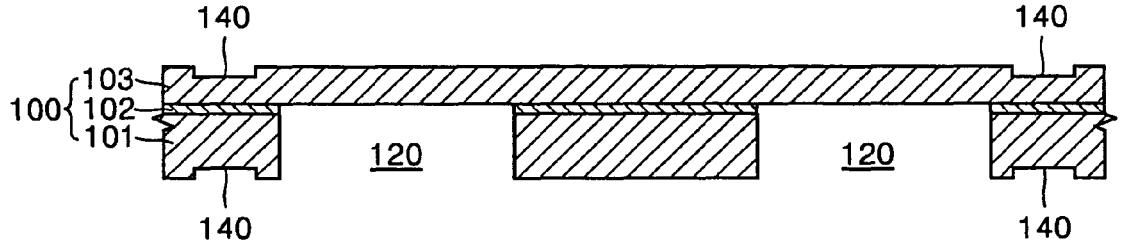

Thus, the upper substrate 100 in which the base mark 140 is formed in the vicinity of the edge of the top and bottom surfaces of the upper substrate 100 and the pressure chamber 120 is formed on the bottom of the upper substrate 100, is prepared, as shown in FIG. 9F.

As above, the upper substrate 100 is dry etched using the photoresist (PR) as the etching mask, thereby forming the pressure chamber 120 and then stripping the photoresist (PR). However, on the contrary, if the PR is stripped, and then the upper substrate 100 is dry etched, the silicon oxide layer 152*b* may be used as the etching mask to form the pressure chamber 120. That is, if the silicon oxide layer 152*b* formed on the bottom of the upper substrate 100 is comparatively thin, it is preferable that the photoresist (PR) is not stripped, and an etch process is performed to form the pressure chamber 120. If the silicon oxide layer 152*b* is comparatively thick, the photoresist (PR) is stripped, and then an etch process is performed to form the pressure chamber 120 using the silicon oxide layer 152*b* as the etching mask.

Figure 9G:
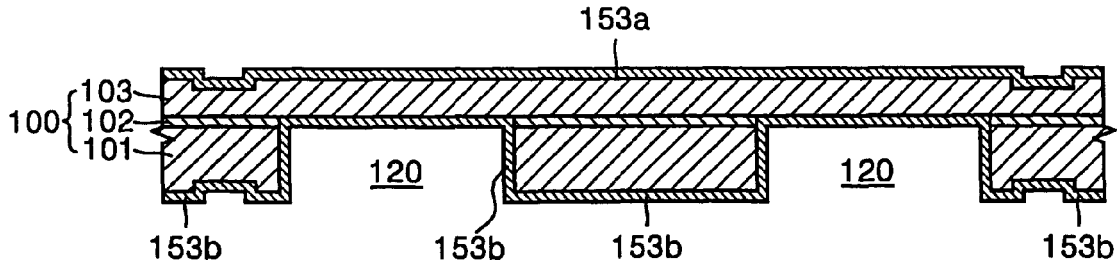

Silicon oxide layers 153*a* and 153*b* may again be formed on the top and bottom of the upper substrate 100 of FIG. 9F, respectively, as shown in FIG. 9G. In this case, the intermediate oxide layer 102 of which part is removed in the step shown in FIG. 9F, is compensated by the silicon oxide layer 153*b*. Likewise, if the silicon oxide layers 153*a* and 153*b* are formed, the step of forming a silicon oxide layer 180 as an insulating layer on the upper substrate 100 may be omitted in the step of FIG. 15A, which will be described later. In addition, if the silicon oxide layer 153*b* is formed inside the pressure chamber 120 for forming an ink passage, because of characteristics of the silicon oxide layer 153*b*, the silicon oxide layer 153*b* does not react with almost all kinds of ink, and thus a variety of ink may be used.

Meanwhile, although not shown, the ink supply hole (110 of FIG. 5) is also formed together with the pressure chamber 120 through the steps illustrated in FIGS. 9A through 9G. That is, in the step shown in FIG. 9G, the ink supply hole (110 of FIG. 5) having the same depth as a predetermined depth of the pressure chamber 120 is formed on the bottom of the upper substrate 100 together with the pressure chamber 120. The ink supply hole (110 of FIG. 5) formed to the predetermined depth on the bottom of the upper substrate 100, is penetrated using a sharp tool, such as a pin, after all manufacturing processes are completed.

FIGS. 10A through 10E illustrate cross-sectional views of stages in the formation of a restrictor on an intermediate substrate according to an embodiment of the present invention.

Figure 10A:
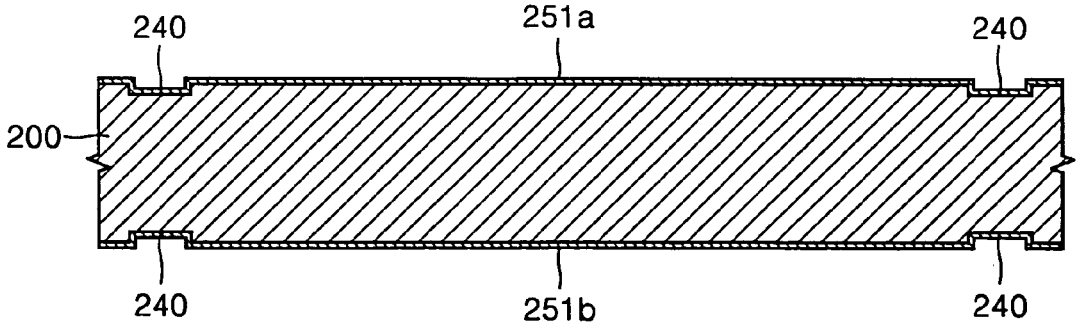
FIGS. 10A through 10E illustrate cross-sectional views of stages in the formation of a restrictor on an intermediate substrate.

Referring to FIG. 10A, an intermediate substrate 200 is formed of a monocrystalline silicon substrate, and the thickness of the intermediate substrate 200 is between about 200 to 300 μm. The thickness of the intermediate substrate 200 may be properly determined by the depth of the ink reservoir (210 of FIG. 5) formed on the intermediate substrate 200 and the length of the penetrated damper (230 of FIG. 5). A base mark 240 is formed in the vicinity of an edge of the top and bottom surfaces of the intermediate substrate 200. Steps for forming the base mark 240 on the intermediate substrate 200 are the same as those shown in FIGS. 8A through 8E, and thus are not separately illustrated and described here.

If the intermediate substrate 200, in which the base mark 240 is formed, is put in the oxidation furnace and is wet or dry etched, the top and bottom surfaces of the intermediate substrate 200 are oxidized, thereby silicon oxide layers 251*a* and 251*b* are formed, respectively, as shown in FIG. 10A.

Figure 10B:
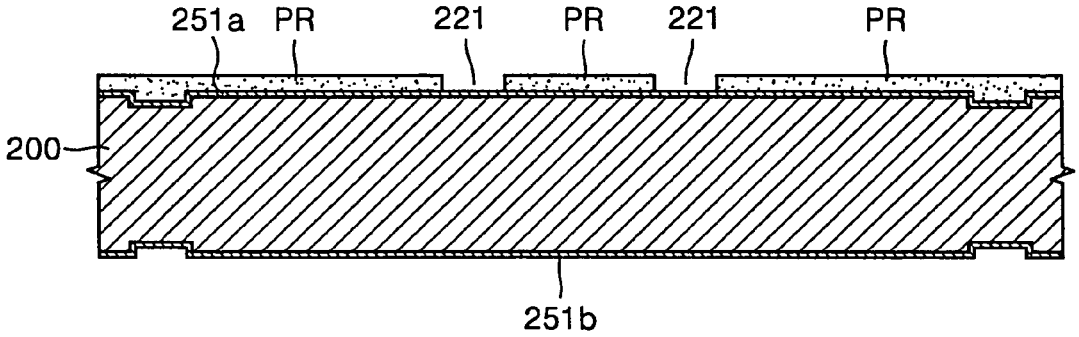

Next, a photoresist (PR) is coated on the surface of the silicon oxide layer 251*a* formed on the top of the intermediate substrate 200, as shown in FIG. 10B. Subsequently, the coated photoresist (PR) is developed, thereby forming an opening 221 for forming a restrictor on the top of the intermediate substrate 200.

Figure 10C:
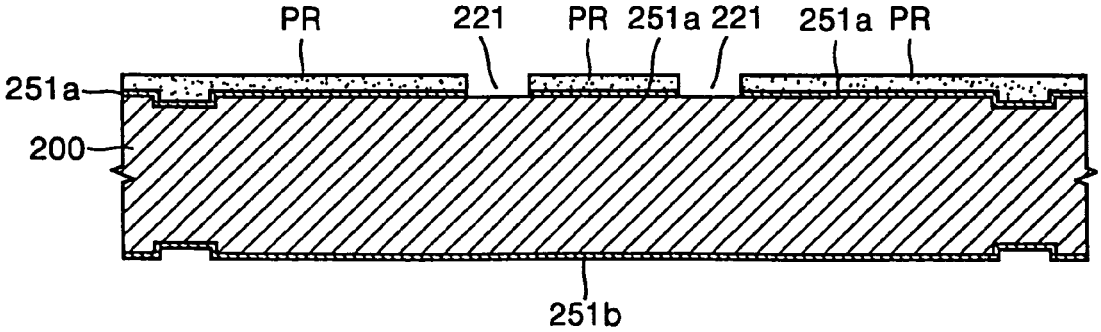

Next, a portion of the silicon oxide layer 251*a* exposed through the opening 221 is wet etched using the photoresist (PR) as an etch mask and removed, thereby partially exposing the top surface of the intermediate substrate 200, as shown in FIG. 10C. In this case, the silicon oxide layer 251*a* may be removed not through wet etching but through dry etching, such as RIE.

Figure 10D:
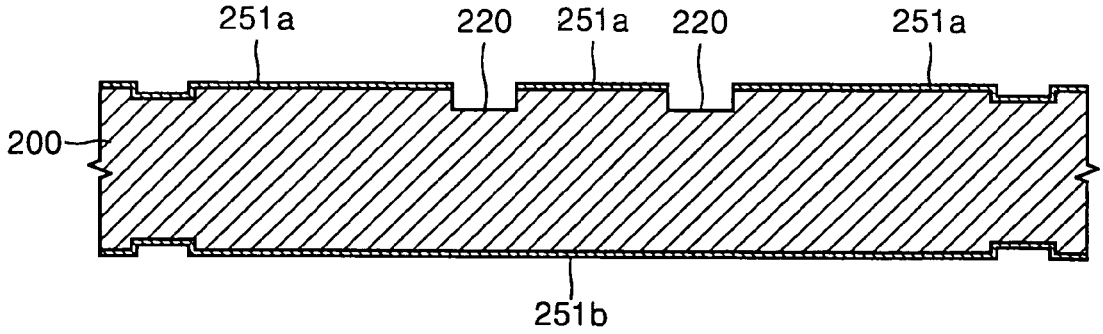

Then, the photoresist (PR) is stripped, and the exposed portion of the intermediate substrate 200 is wet or dry etched to a predetermined depth using the silicon oxide layer 251*a* as an etching mask, thereby forming a restrictor 220, as shown in FIG. 10D. In this case, when the intermediate substrate 200 is wet etched, tetramethyl ammonium hydroxide (TMAH) or KOH, for example, may be used as a silicon etchant.

Figure 10E:
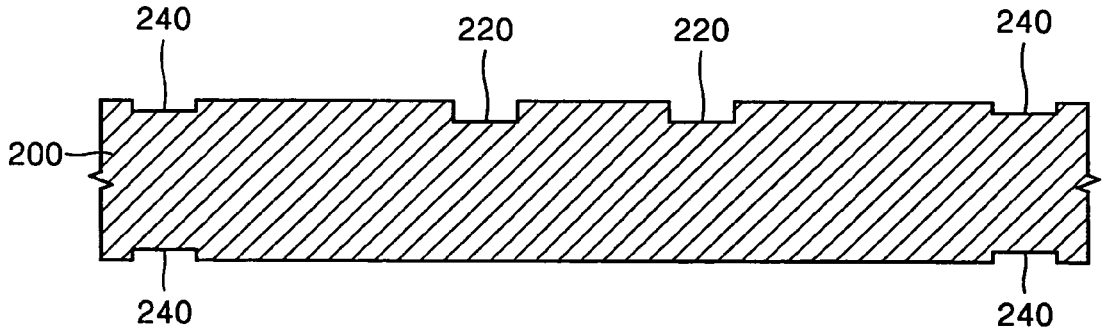

Subsequently, if the remaining silicon oxide layers 251*a* and 251*b* are removed through wet etching, the intermediate substrate 200 in which the base mark 240 is formed in the vicinity of the edge of the top and bottom surfaces and the restrictor 220 is formed in the vicinity of the center of the top surface of the intermediate substrate 200, is prepared, as shown in FIG. 10E.

The T-shaped restrictor, shown in FIG. 7, is not formed in the above steps. Specifically, in the above steps, only the base mark 240 is formed on the intermediate substrate 200. Then, a T-shaped restrictor may be formed together with an ink reservoir using the same method as a method for forming an ink reservoir in the following steps.

FIGS. 11A through 11J illustrate cross-sectional views of stages in a first method for forming an ink reservoir and a damper on the intermediate substrate in a stepwise manner.

Figure 11A:
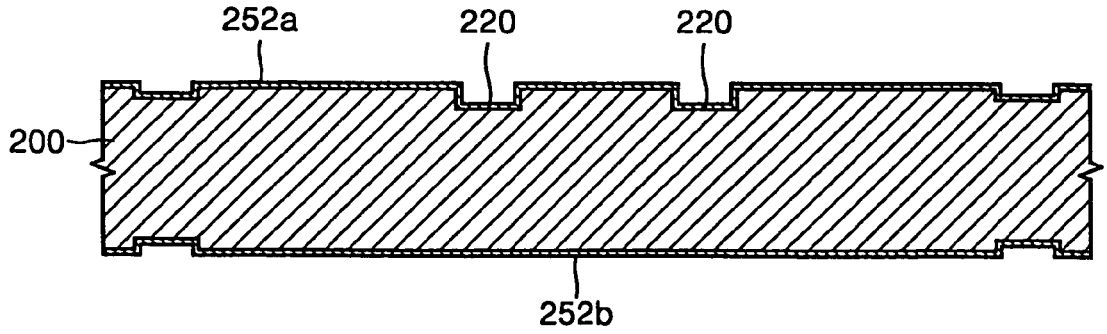
FIGS. 11A through 11J illustrate cross-sectional views of stages in a first method for forming an ink reservoir and a damper on the intermediate substrate in a stepwise manner.

The intermediate substrate 200 is put in the oxidation furnace and is wet or dry oxidized, thereby forming silicon oxide layers 252*a* and 252*b* on the top and bottom of the intermediate substrate 200, respectively, as shown in FIG. 11A. In this case, the silicon oxide layer 252*a* may be formed in a portion in which the restrictor 220 is formed.

Figure 11B:
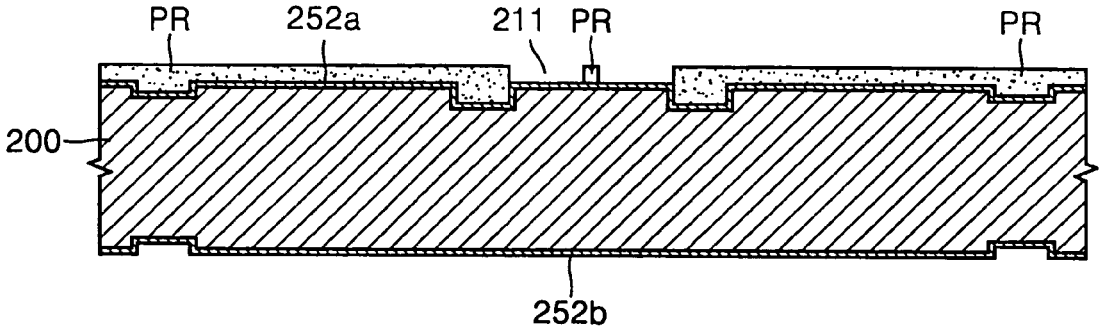

Next, a photoresist (PR) is coated on the surface of the silicon oxide layer 252*a* formed on the top of the intermediate substrate 200, as shown in FIG. 11B. Subsequently, the coated photoresist (PR) is developed, thereby forming an opening 211 for forming an ink reservoir on the top of the intermediate substrate 200. In this case, the photoresist (PR) remains in a portion in which a barrier wall is to be formed in the ink reservoir.

Figure 11C:
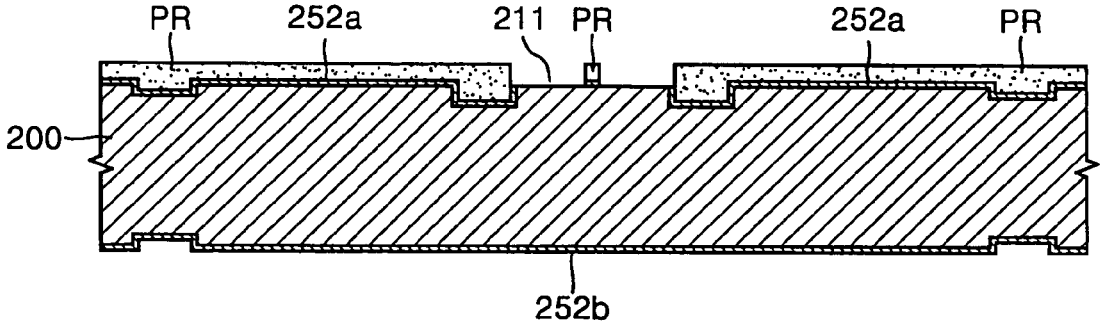

Next, a portion of the silicon oxide layer 252*a* exposed through the opening 211 is removed through wet etching using the photoresist (PR) as an etching mask, thereby partially exposing the top surface of the intermediate substrate 200, as shown in FIG. 11C. In this case, the silicon oxide layer

252*a* may also be removed, not through wet etching, but through a dry etching, such as RIE.

Figure 11D:
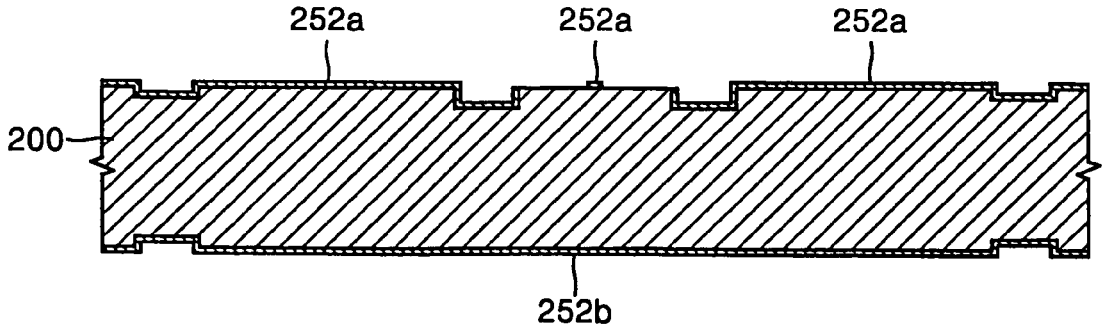

Subsequently, after the photoresist (PR) is stripped, the intermediate substrate 200 is formed, as shown in FIG. 11D. Only a portion of the top surface of the intermediate substrate 200, in which the ink reservoir is to be formed, is exposed, and the remaining portion of the top surface is covered with the silicon oxide layer 252*a*. The bottom surface of the intermediate substrate 200 remains covered by the silicon oxide layer 252*b*.

Figure 11E:
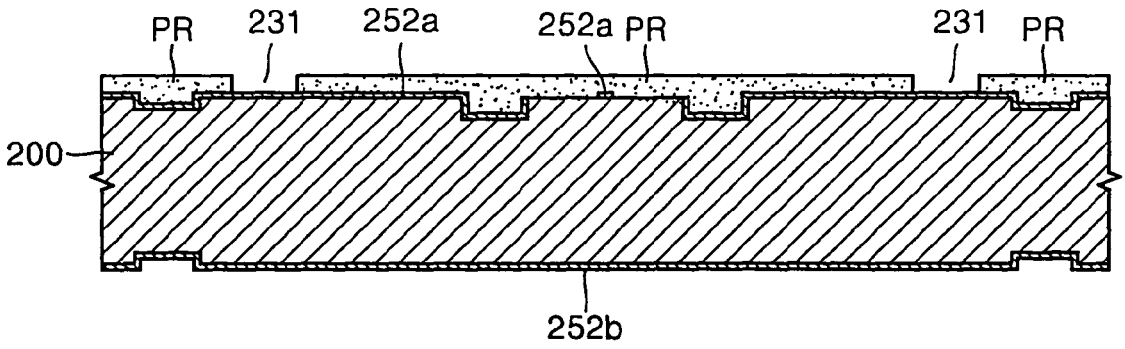

Next, a photoresist (PR) is again coated on the surface of the silicon oxide layer 252*a* formed on the top of the intermediate substrate 200, as shown in FIG. 11E. In this case, the exposed portion of the top surface of the intermediate substrate 200 is also covered with the photoresist (PR). Subsequently, the coated photoresist (PR) is developed, thereby forming an opening 231 for forming a damper on the top of the intermediate substrate 200.

Figure 11F:
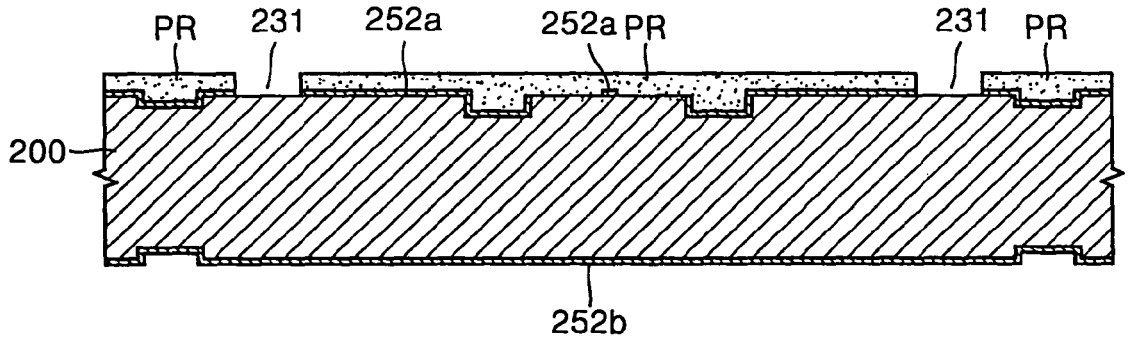
Figure 11G:
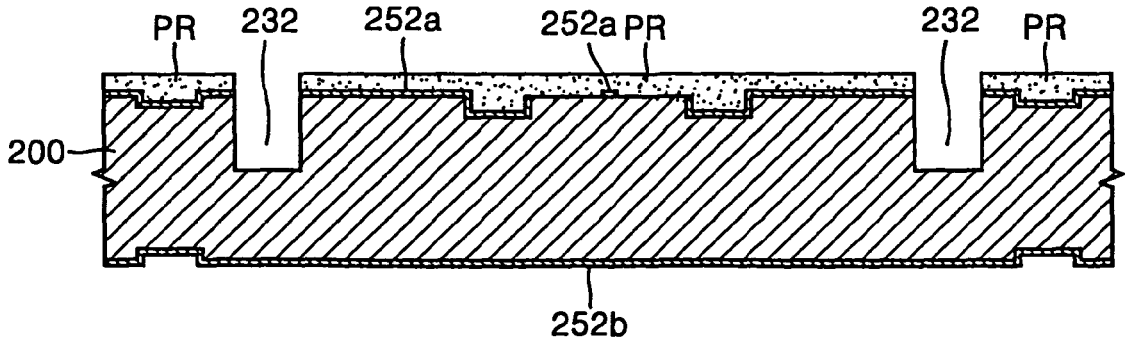

Next, a portion of the silicon oxide layer 252*a* exposed through the opening 231 is removed through wet etching using the photoresist (PR) as an etching mask, thereby partially exposing the top surface of the intermediate substrate 200 in which the damper is to be formed, as shown in FIG. 11F. In this case, the silicon oxide layer 252*a* may also be removed not through wet etching but through dry etching, such as RIE.

Subsequently, the exposed portion of the intermediate substrate 200 is etched to a predetermined depth using the photoresist (PR) as the etching mask, thereby a damper forming hole 232 is formed. In this case, etching of the intermediate substrate 200 may be performed through dry etching using ICP.

Figure 11H:
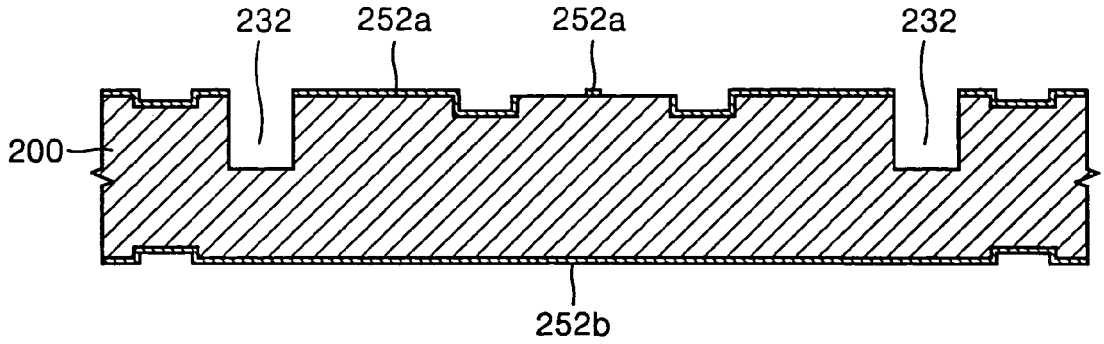

Next, if the photoresist (PR) is stripped, the portion of the top surface of the intermediate substrate 200 in which the ink reservoir is to be formed is again exposed, as shown in FIG. 11H.

Figure 11I:
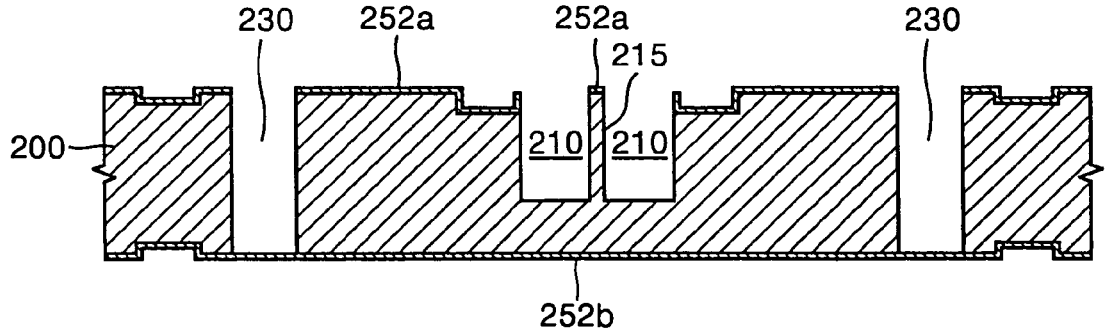

Subsequently, after the exposed portion of the top surface of the intermediate substrate 200 and the bottom surface of the damper forming hole 232 are dry etched using the silicon oxide layer 252*a* as the etching mask, a damper 230 through which the intermediate substrate 200 is passed, and the ink reservoir 210 having the predetermined depth are formed, as shown in FIG. 11I. In addition, a barrier wall 252, which divides the ink reservoir 210 in a vertical direction, is formed in the ink reservoir 210. In this case, etching of the intermediate substrate 200 may be performed through dry etching using ICP.

Next, the remaining silicon oxide layers 252*a* and 252*b* may be removed through wet etching. This step is performed to clean foreign particles, such as by-products occurring from the performance of the above steps, simultaneously with the removal of the silicon oxide layers 252*a* and 252*b*. As such, the intermediate substrate 200 in which the base mark 240, the restrictor 220, the ink reservoir 210, the barrier wall 215, and the damper 230 are formed, is prepared, as shown in FIG. 11J.

Figure 11J:
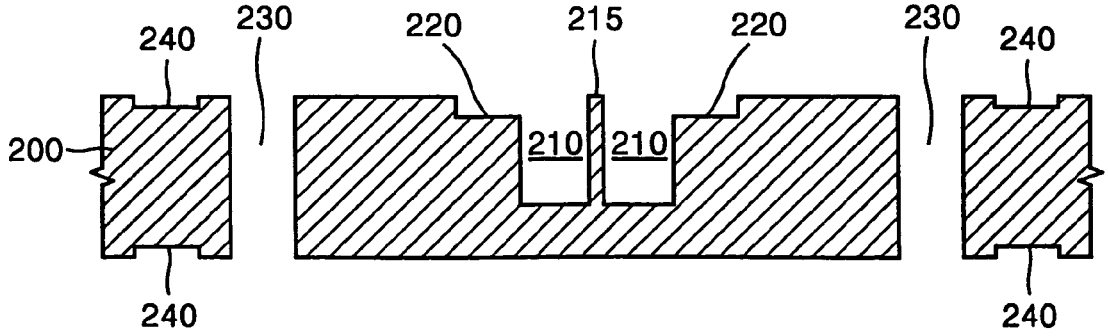

Meanwhile, although not shown, a silicon oxide layer may be again formed on the entire top and bottom surfaces of the intermediate substrate 200 of FIG. 11J.

Figure 12A:
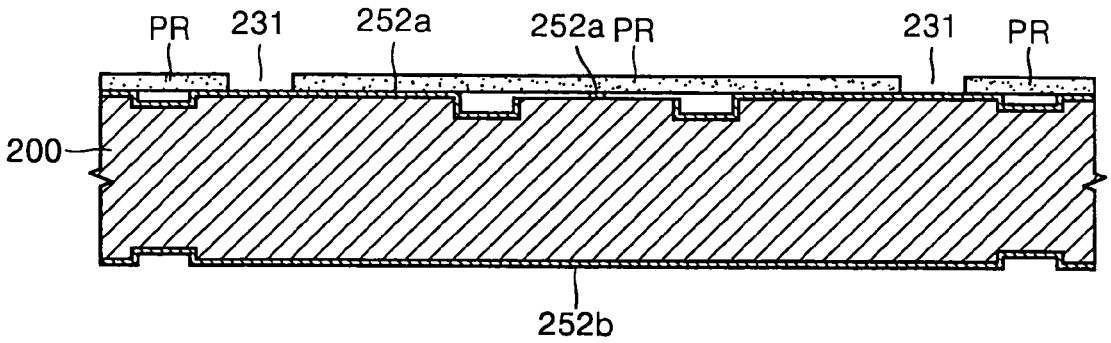
FIGS. 12A and 12B illustrate cross-sectional views of stages in a second method for forming the ink reservoir and the damper on the intermediate substrate in a stepwise manner.
Figure 12B:
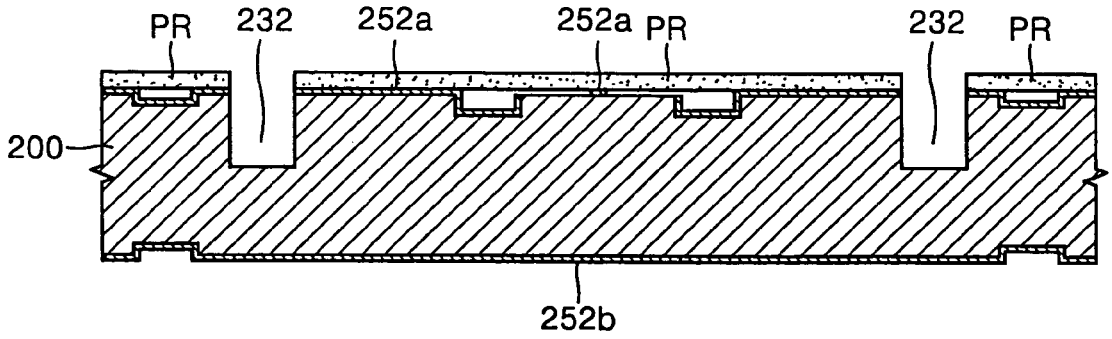

FIGS. 12A and 12B illustrate cross-sectional views of stages in a second method for forming the ink reservoir and the damper on the intermediate substrate in a stepwise manner. The second method, which will be described below, is similar to the first method, except for the formation of a damper. Thus, hereinafter, only parts differing from the above-mentioned first method will be described.

In the second method, steps of exposing only the portion in which the ink reservoir is to be formed of the top surface of the intermediate substrate 200 are the same as those shown in FIGS. 11A through 11D.

Next, the photoresist (PR) is coated on the surface of the silicon oxide layer 252*a* formed on the top of the intermediate substrate 200, as shown in FIG. 12A. In this case, the photoresist (PR) having a dry film shape is coated on the surface of the silicon oxide layer 252*a* using a lamination method including heating, pressurizing, and compressing processes. The dry film-shaped photoresist (PR) serves as a protecting layer for protecting another portion of the intermediate substrate 200 during a sand blasting process, which will be described later. Subsequently, the coated photoresist (PR) is developed, thereby forming the opening 231 for forming a damper.

Subsequently, if the silicon oxide layer 252*a* exposed through the opening 231 and the intermediate substrate 200 up to a predetermined depth under the silicon oxide layer 252*a* are removed through sand blasting, a damper forming hole 232 having a predetermined depth is formed, as shown in FIG. 12B.

The next steps are the same as those shown of the first method shown in FIGS. 11H through 11J.

The second method, however, differs from the first method in that the damper forming hole 232 is formed not through dry etching but through sand blasting. That is, in order to form the damper forming hole 232, in the first method, the silicon oxide layer 252*a* is etched, and then the intermediate substrate 200 is dry etched to a predetermined depth. In the second method, however, the silicon oxide layer 252*a* and the intermediate substrate 200 having the predetermined depth are removed through sand blasting at the same time. Thus, the number of processes of the second method can be reduced as compared to the number of processes of the first method, thereby also reducing the total processing time.

FIGS. 13A through 13H illustrate cross-sectional views of stages in the formation of a nozzle on a lower substrate.

Figure 13A:
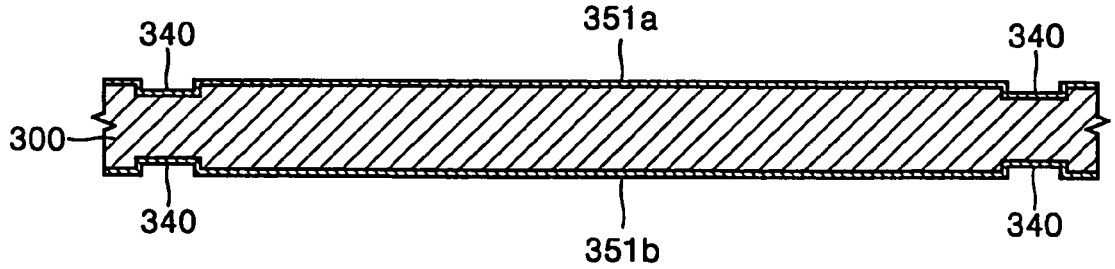
FIGS. 13A through 13H illustrate cross-sectional views of stages in the formation of a nozzle on a lower substrate.

Referring to FIG. 13A, a lower substrate 300 is formed of a monocrystalline silicon substrate, and the thickness of the lower substrate 300 is about 100 to 200 μm. A base mark 340 is formed in the vicinity of an edge of the top and bottom surfaces of the lower substrate 300. Steps for forming the base mark 340 on the lower substrate 300 are the same as those shown in FIGS. 8A through 8E, and thus descriptions thereof will be omitted.

If the lower substrate 300, in which the base mark 340 is formed, is put in an oxidation furnace and is wet or dry etched, the top and bottom surfaces of the lower substrate 300 are oxidized, thereby silicon oxide layers 351*a* and 351*b* are formed, respectively, as shown in FIG. 13A.

Figure 13B:
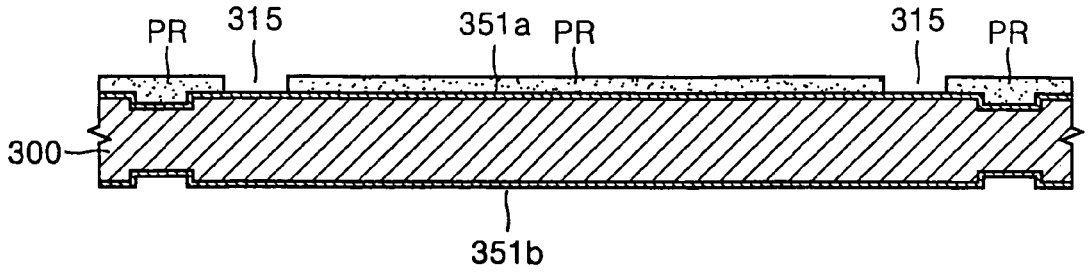

Next, a photoresist (PR) is coated on the surface of the silicon oxide layer 351*a* formed on the top of the lower substrate 300, as shown in FIG. 13B. Subsequently, the coated photoresist (PR) is developed, thereby forming an opening 315 for forming an ink induction part of a nozzle on the top of the lower substrate 200. The opening 315 is formed in a position which corresponds to the position of the damper 230 formed on the intermediate substrate 200, shown in FIG. 11J.

Figure 13C:
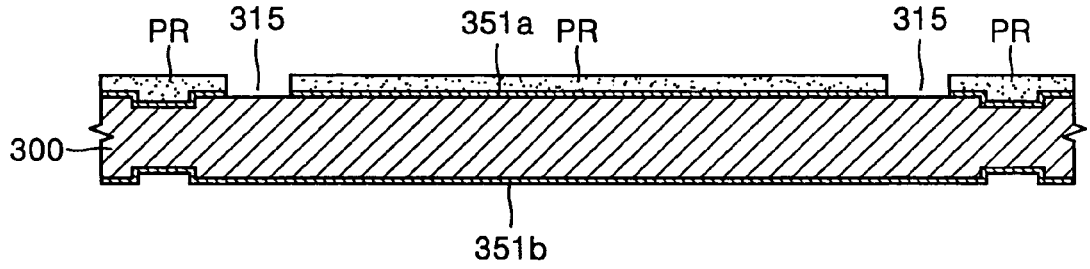

Next, a portion of the silicon oxide layer 351*a* exposed through the opening 315 is wet etched using the photoresist (PR) as an etch mask and removed, thereby partially exposing the top surface of the lower substrate 300, as shown in FIG. 13C. In this case, a portion of the silicon oxide layer 351*a* exposed through the opening 315 may be removed not through wet etching but through a dry etching, such as RIE.

Figure 13D:
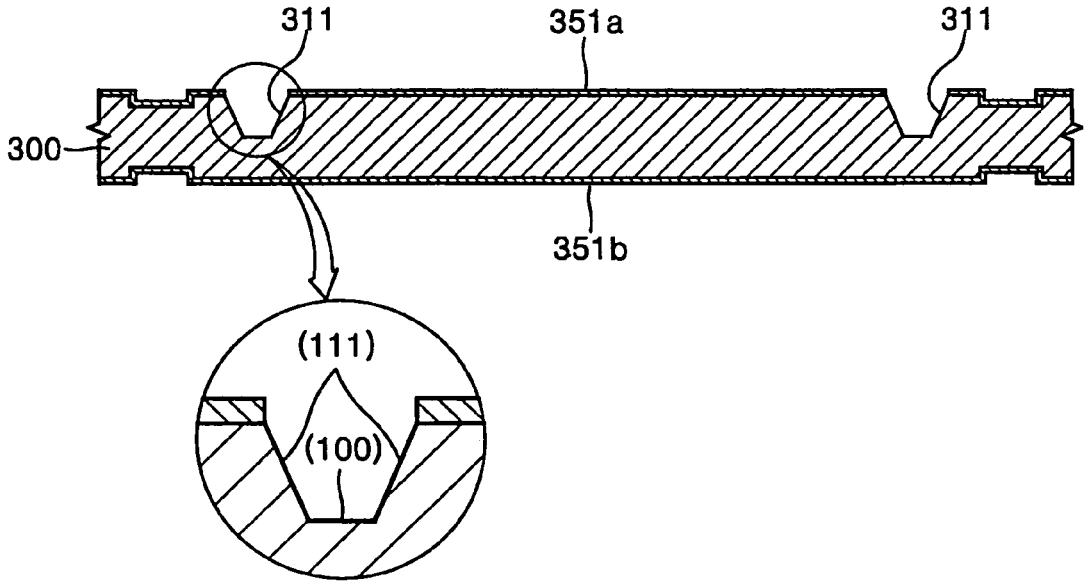

Then, the photoresist (PR) is stripped, and the exposed portion of the lower substrate 300 is wet etched to a predetermined depth using the silicon oxide layer 351*a* as an etching mask, thereby forming an ink induction part 311, as shown in FIG. 13D. In this case, when the lower substrate 300 is wet etched, for example, tetramethyl ammonium hydroxide (TMAH) or KOH may be used for an etchant. If a silicon substrate having a crystalline face in a direction (100) is used for the lower substrate 300, the ink induction part 311 having a quadrangular pyramidal shape can be formed using anisotropic wet etching characteristics of faces (100) and (111). That is, an etch rate of the face (111) is much smaller than the etch rate of the face (100), and thus the lower substrate 300 is etched inclined along the face (111) to form the ink induction part 311 having the quadrangular pyramidal shape. Accordingly, the bottom surface of the ink induction part 311 becomes the face (100), as shown in the enlarged portion of FIG. 13D.

Figure 13E:
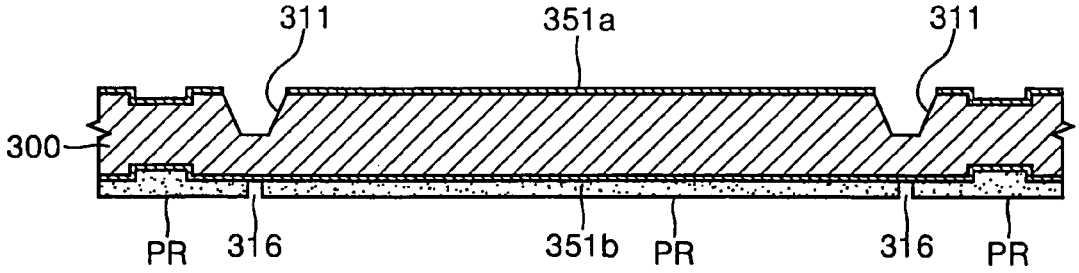

Next, the photoresist (PR) is coated on the surface of the silicon oxide layer 351*b* formed on the bottom of the lower substrate 300, as shown in FIG. 13E. Subsequently, the coated photoresist (PR) is developed, thereby forming an opening 316 for forming an orifice of a nozzle on the bottom of the lower substrate 300.

Figure 13F:
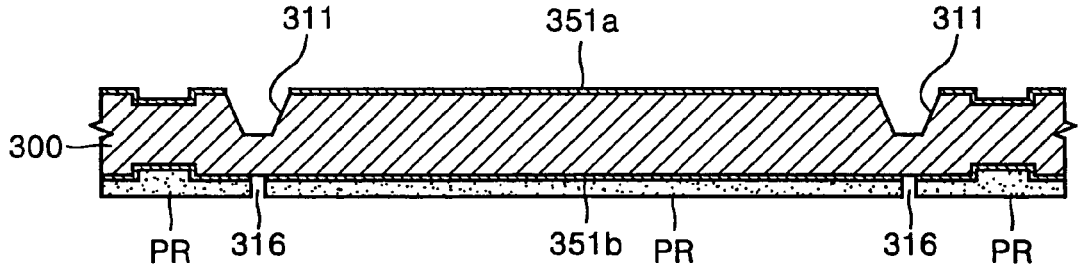

Next, a portion of the silicon oxide layer 351*b* exposed through the opening 316 is wet etched using the photoresist (PR) as an etch mask and is removed, thereby partially exposing the bottom surface of the lower substrate 300, as shown in FIG. 13F. In this case, the silicon oxide layer 351*b* may be removed not through wet etching but through dry etching, such as RIE.

Figure 13G:
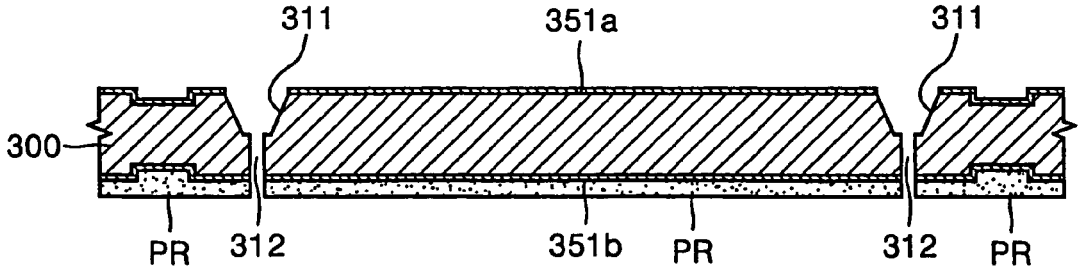

Next, the exposed portion of the lower substrate 300 is etched using the PR as the etch mask so that the nozzle can be passed through the lower substrate 300, thereby forming an orifice 312 connected to the ink induction part 311, as shown in FIG. 13G. In this case, etching of the lower substrate 300 may be performed through dry etching using ICP.

Figure 13H:
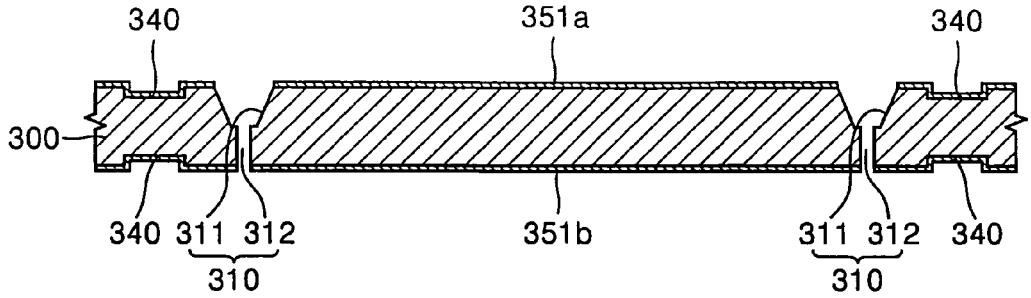

Subsequently, after the photoresist (PR) is stripped, the lower substrate 300, in which a base mark 340 is formed in the vicinity of edges of the top and bottom surfaces of the lower surface 300 and through which a nozzle 310 including the ink induction part 311 and the orifice 312 is passed, is prepared, as shown in FIG. 13H. In the above-described method, the orifice 312 is formed after the ink induction part 311 is formed, however, alternatively, the ink induction part 311 may be formed after the orifice 312 is formed.

Also, the silicon oxide layers 351*a* and 351*b* formed on the top and bottom of the lower substrate 300 may be removed during a cleaning process, and subsequently, a new silicon oxide layer (not shown) may be again formed on the entire surface of the lower substrate 300.

Figure 14:
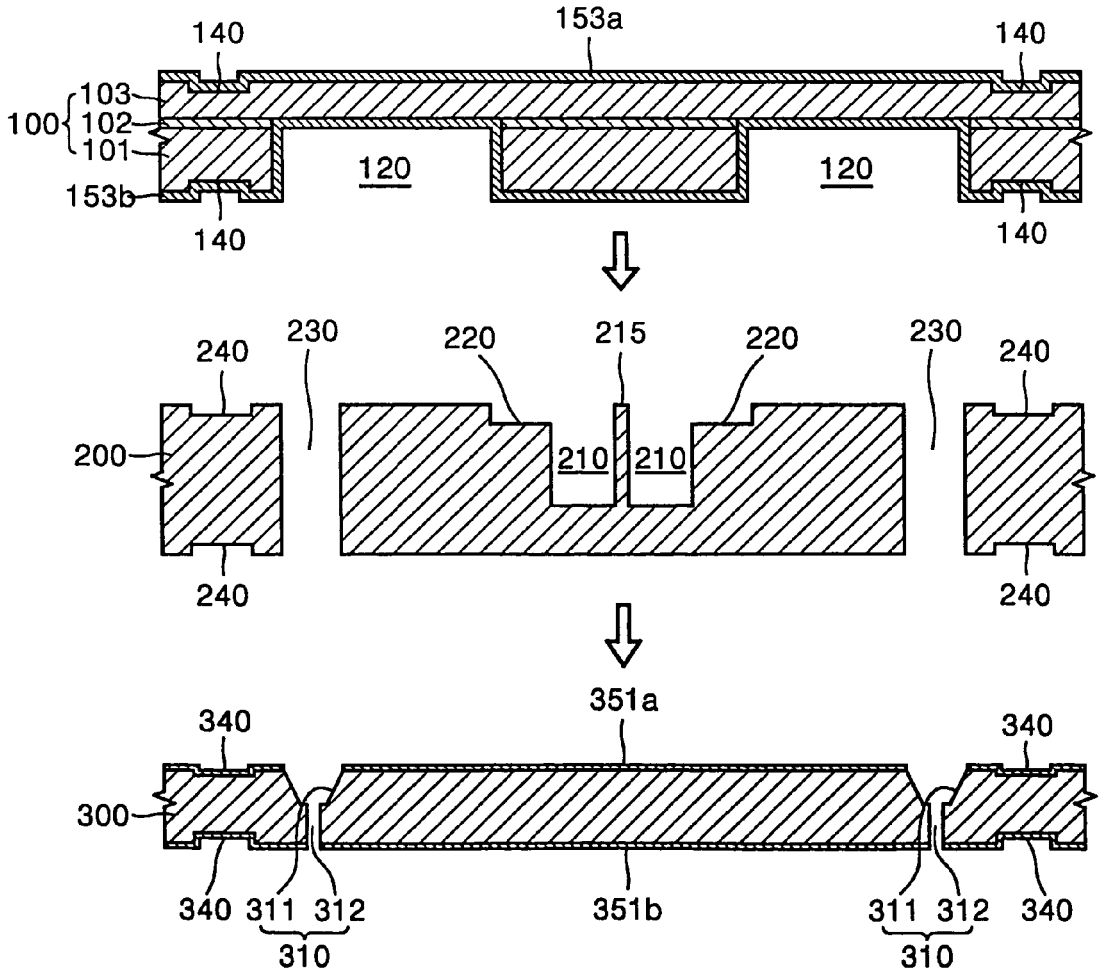
FIG. 14 illustrates a cross-sectional view of stages in the sequential stacking of the lower substrate, the intermediate substrate, and the upper substrate, and the adhesion of the substrates to one another.

FIG. 14 illustrates a cross-sectional view of stages in the sequential stacking of the lower substrate, the intermediate substrate, and the upper substrate and adhering them to one another.

Referring to FIG. 14, the lower substrate 300, the intermediate substrate 200, and the upper substrate 100, which are prepared through the above-mentioned steps, are sequentially stacked on one another and are adhered to one another. In this case, the intermediate substrate 200 is adhered to the lower substrate 300, and then the upper substrate 100 is adhered to the intermediate substrate 200, but an adhesion order may be varied. The three substrates 100, 200, and 300 may be aligned using a mask aligner, and alignment base marks 140, 240, and 340 are formed on each of the three substrates 100, 200, and 300, and thus an alignment precision is high. Adhesion of the three substrates 100, 200, and 300 may be performed through well-known silicon direct bonding (SDB). Meanwhile, in a SDB process, silicon adheres better to a silicon oxide layer than to another silicon layer. Thus, preferably, the upper substrate 100 and the lower substrate 300, on which the silicon oxide layers 153*a*, 153*b*, 351*a*, and 351*b* are formed, are bonded to the intermediate substrate 200, on which a silicon oxide layer is not formed, as shown in FIG. 14.

Figure 15A:
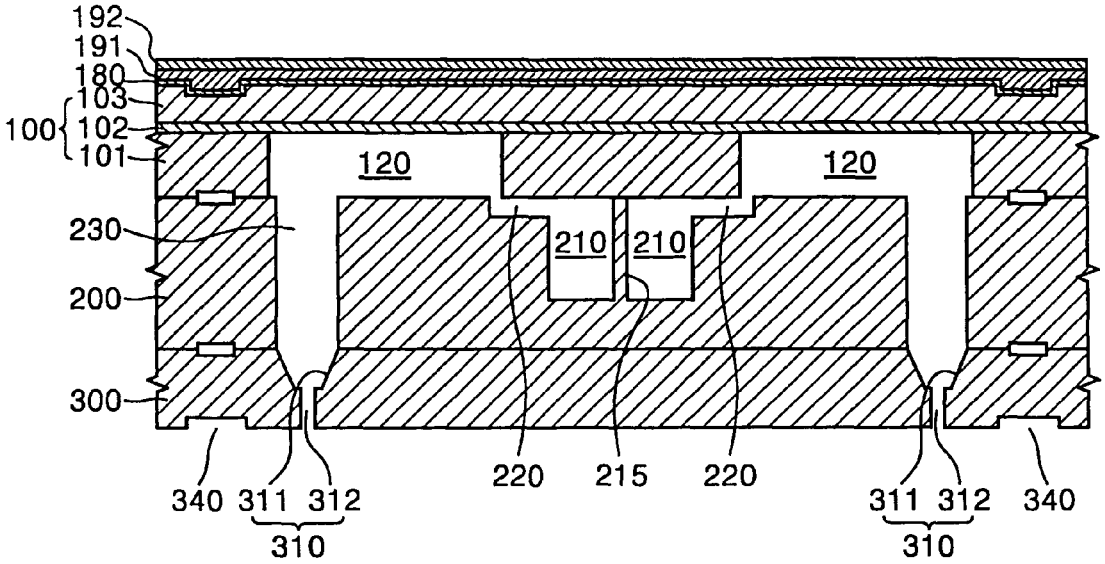
FIGS. 15A and 15B illustrate cross-sectional views of the final stages in the completion of the piezoelectric ink-jet printhead according to an embodiment of the present invention by forming a piezoelectric actuator on the upper substrate.
Figure 15B:
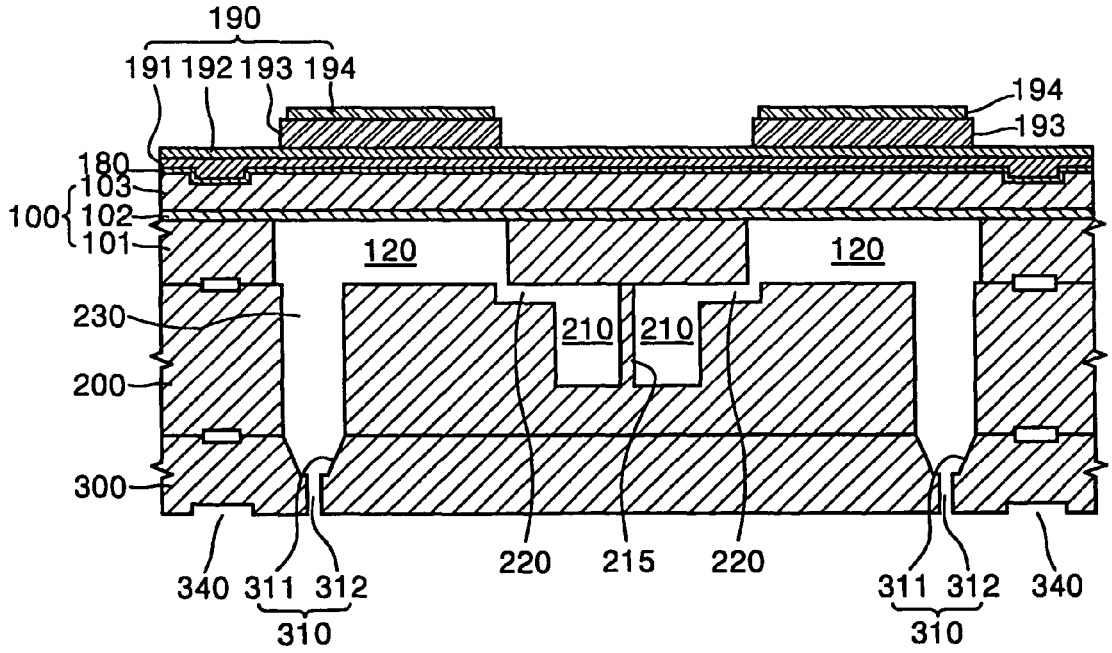

FIGS. 15A and 15B illustrate cross-sectional views of stages in the completion of the piezoelectric ink-jet printhead according to the present invention by forming a piezoelectric actuator on the upper substrate.

Referring to FIG. 15A, the lower substrate 100, the intermediate substrate 200, and the upper substrate 300 are stacked on one another in sequence and are adhered to one another, and a silicon oxide layer 180 is formed as an insulating layer on the top of the upper substrate 100. However, the step of forming the silicon oxide layer 180 may be omitted. That is, if the silicon oxide layer 153*a* has already been formed on the top of the upper substrate 100, as shown in FIG. 14, or if an oxide layer having a predetermined thickness has already been formed on the top of the upper substrate 100 in an annealing step of the above-mentioned SDB process, there is no requirement to form the silicon oxide layer 180, shown in FIG. 15A, as an insulating layer on the top of the upper substrate 100.

Subsequently, lower electrodes 191 and 192 of a piezoelectric actuator are formed on the silicon oxide layer 180, if present. The lower electrodes 191 and 192 are formed of two thin metal layers, such as a Ti layer 191 and a Pt layer 192. The Ti layer 191 and the Pt layer 192 may be formed by sputtering the entire surface of the silicon oxide layer 180 to a predetermined thickness. The Ti layer 191 and the Pt layer 192 serve as a common electrode of the piezoelectric actuator and further serve as a diffusion barrier layer which prevents interdiffusion between the piezoelectric layer (193 of FIG. 15B) formed thereon and the upper substrate 100 formed thereunder. In particular, the lower Ti layer 191 serves to improve an adhesion property of the Pt layer 192.

Next, the piezoelectric layer 193 and the upper electrode 194 are formed on the lower electrodes 191 and 192, as shown in FIG. 15B. Specifically, a piezoelectric material in a paste state is coated on the pressure chamber 120 to a predetermined thickness through screen-printing, and then is dried for a predetermined amount of time. Preferably, typical lead zirconate titanate (PZT) ceramics are used for the piezoelectric layer 193. Subsequently, an electrode material, for example, Ag—Pd paste, is printed on the dried piezoelectric layer 193. Next, the piezoelectric layer 193 is sintered at a predetermined temperature, for example, at about 900 to 1000° C. In this case, the Ti layer 191 and the Pt layer 192 prevent interdiffusion between the piezoelectric layer 193 and the upper substrate 100 which may occur during a high temperature sintering process of the piezoelectric layer 193.

As such, a piezoelectric actuator 190 including the lower electrodes 191 and 192, the piezoelectric layer 193, and the upper electrode 194 is formed on the upper substrate 100.

Meanwhile, sintering of the piezoelectric layer 193 is performed under atmospheric conditions, and thus in the sintering step, a silicon oxide layer is formed inside the ink passage formed on the three substrates 100, 200, and 300. The silicon oxide layer does not react with almost all kinds of ink, and thus a variety of ink may be used. In addition, the silicon oxide layer has a hydrophilic property, and thus the in-flow of air bubbles is prevented when ink initially flows, and the occurrence of air bubbles is suppressed when ink is ejected through the nozzle.

Last, when a dicing process for cutting the adhered three substrates 100, 200, and 300 in units of a chip and a polling process of generating piezoelectric characteristics by applying an electric filed to the piezoelectric layer 193 are performed, the piezoelectric ink-jet printhead according to the present invention is completed. Meanwhile, the dicing process may be performed before the above-mentioned sintering step of the piezoelectric layer 193.

As described above, the piezoelectric ink-jet printhead and the method for manufacturing the same according to the present invention have several advantages.

First, elements constituting the ink passage can be precisely and easily formed to a fine size on each of the three substrates formed of a monocrystalline silicon, using a silicon micromachining technology. Thus, a processing tolerance is reduced, thereby minimizing a deviation in ink ejecting performance. In addition, a silicon substrate is used in the present invention, and thus can also be used in a process of manufacturing typical semiconductor devices, thereby facilitating mass production. Thus, the present invention is suitable for high-density printheads in order to improve printing resolution.

Second, the three substrates are stacked on one another and are adhered to one another using the mask aligner, thereby a precise alignment and high productivity are obtained. That is, the number of adhered substrates is reduced compared with conventional arrangements, thereby alignment and adhering processes are simplified, and an error in the alignment process is also reduced. In particular, if the base mark is formed on each substrate, precision in the alignment process is further improved.

Third, since the three substrates forming the printhead are formed of a monocrystalline silicon substrate, an adhering property thereto is high. Even through there is a variation in an ambient temperature when printing, since the thermal expansion coefficients of the substrates are equal to one another, a deformation or a subsequent alignment error does not occur.

Fourth, since a monocrystalline silicon substrate is used as a basic material, the surface roughness of an etch face is reduced after a dry or wet etch process, which enhances ink flow.

Fifth, since the silicon oxide layer, which does not react with almost all kinds of ink and has a hydrophilic property, is formed inside the ink passage in several steps of the manufacturing process, a variety of inks may be used, and the in-flow of air bubbles may be prevented when ink initially flows, and the occurrence of air bubbles may be suppressed when ink is ejected through the nozzle.

Sixth, since part of the upper substrate formed of silicon with high mechanical characteristics serves as a vibration plate, the mechanical characteristics do not decrease even when the upper substrate is coupled to the piezoelectric actuator and the piezoelectric actuator is driven for a long time.

Seventh, inter-diffusion between the piezoelectric layer and the upper substrate, in particular, between the piezoelectric layer and the vibration plate, which may occur during the sintering step of the piezoelectric layer, is prevented by the Ti and Pt layers, and the piezoelectric actuator and the vibration plate are adhered to each other without a gap therebetween, thereby deformation of the piezoelectric layer can be transferred to the vibration plate without temporal delay or displacement damages. Thus, since the vibration plate immediately vibrates by driving the piezoelectric actuator, ink ejection movement is performed rapidly. In addition, the present invention has the above-mentioned advantages even when the piezoelectric actuator is driven in a radio frequency region.

Eighth, when an ink-jet printhead has a T-shaped restrictor, flow resistance of ink supplied to the pressure chamber from the ink reservoir may be reduced, and a pressure loss in a step of supplying ink through the restrictor may be reduced. As such, quantity of flow passing the restrictor is increased such that ink is more smoothly and quickly refilled in the pressure chamber. Thus, even when the ink-jet printhead is driven in a high frequency region, uniform ink ejection volume and ink ejection speed can be obtained.

Preferred embodiments of the present invention have been disclosed herein and, although specific terms are employed, they are used and are to be interpreted in a generic and descriptive sense only and not for purpose of limitation. For example, forming elements of a piezoelectric ink-jet printhead according to the present invention, and a variety of etch methods may be applied in manufacturing an ink-jet printhead, and the order of each step of the method for manufacturing the piezoelectric ink-jet printhead may be varied. Accordingly, it will be understood by those of ordinary skill in the art that various changes in form and details may be made without departing from the spirit and scope of the present invention as set forth in the following claims.

What is claimed is:

1. A method for manufacturing a plurality of piezoelectric ink-jet printheads, comprising:

forming a monocrystalline silicon upper substrate having extended therethrough ink supply holes, through which ink is to be supplied and which correspond to the plurality of printheads, the upper substrate also having pressure chambers, which are to be filled with ink to be ejected, which have first and second ends, and which respectively correspond to the ink supply holes, wherein the pressure chambers are positioned at a bottom surface of the upper substrate;

forming a monocrystalline silicon intermediate substrate having ink reservoirs, which correspond to the plurality of printheads, which are respectively connected to the ink supply holes, and in which supplied ink is to be stored, the intermediate substrate also having dampers in positions that respectively correspond to the first ends of the pressure chambers, wherein the ink reservoirs are positioned at a top surface of the intermediate substrate;

forming a monocrystalline silicon lower substrate having a plurality of nozzles corresponding to the plurality of printheads and through which ink is to be ejected, wherein the nozzles are positioned to respectively correspond to the dampers;

stacking and adhering the lower substrate and the intermediate substrate on one another, stacking and adhering the intermediate substrate and the upper substrate on one another;

forming piezoelectric actuators, which respectively provide a driving force for ejecting ink from the pressure chambers, on the upper substrate, and dicing the three adhered substrates to respectively form the plurality of printheads, wherein:

each of the printheads includes a restrictor that connects the second end of the respective pressure chambers to a corresponding ink reservoir, the restrictor being on at least one of the bottom surface of the upper substrate and the top surface of the intermediate substrate.

2. The method as claimed in claim 1, wherein the upper substrate is formed to a thickness of about 100 to 200 μm, the intermediate substrate is formed to a thickness of about 200 to 300 μm, and the lower substrate is formed to a thickness of about 100 to 200 μm.

3. The method as claimed in claim 2, wherein the upper substrate is formed to a thickness of about 130 to 150 μm.

4. The method as claimed in claim 1 further comprising forming a base mark on each of the three substrates to align the three substrates during the adhering of the three substrates.

5. The method as claimed in claim 4, wherein forming of the base mark includes etching a vicinity of at least an edge of the bottom surface of the upper substrate and a vicinity of edges of the top and bottom surfaces of the intermediate substrate and the lower substrate to a predetermined thickness, thereby forming the base mark.

6. The method as claimed in claim 5, further comprising forming the base mark through wet etching using a tetramethyl ammonium hydroxide (TMAH) or KOH as an etchant.

7. The method as claimed in claim 1, further comprising, during the forming of the pressure chambers and the ink supply holes, dry etching the bottom surface of the upper substrate to a predetermined depth, thereby simultaneously forming the pressure chambers and the ink supply holes.

8. The method as claimed in claim 7, further comprising, during the forming of the pressure chambers and the ink supply holes, sequentially stacking a silicon-on-insulator (SOI) wafer having a structure in which a first silicon substrate, an intermediate oxide layer, and a second silicon substrate on one another, is used for the upper substrate, and the first silicon substrate is etched using the intermediate oxide layer as an etch stop layer, thereby forming the pressure chambers and the ink supply holes.

9. The method as claimed in claim 8, wherein the second silicon substrate is formed to a thickness of several micrometers to several tens of micrometers.

10. The method as claimed in claim 7, further comprising, after the forming of the pressure chambers and the ink supply holes, cleaning the entire surface of the upper substrate using a tetramethyl ammonium hydroxide (TMAH).

11. The method as claimed in claim 7, further comprising perforating the ink supply holes formed to a predetermined depth on the bottom of the upper substrate after forming the piezoelectric actuators.

12. The method as claimed in claim 1, further comprising, during the forming of the restrictor, dry or wet etching the bottom surface of the upper substrate using a TMAH or KOH as an etchant, thereby forming the restrictor.

13. The method as claimed in claim 1, further comprising, during the forming of the restrictor, dry or wet etching the top surface of the intermediate substrate using a TMAH or KOH as an etchant, thereby forming the restrictor.

14. The method as claimed in claim 1, further comprising, during the forming of the restrictor, respectively dry or wet etching the bottom surface of the upper substrate and the top surface of the intermediate substrate using a TMAH or KOH as an etchant, thereby forming a portion of the restrictor on the bottom of the upper substrate and forming another portion of the restrictor on the top of the intermediate substrate.

15. The method as claimed in claim 1, further comprising, during the forming of the restrictors, dry etching the top surface of the intermediate substrate is etched to a predetermined depth using inductively coupled plasma (ICP), thereby forming the restrictors to have a T-shaped section.

16. The method as claimed in claim 15, wherein forming the restrictors and forming the ink reservoirs are simultaneously performed.

17. The method as claimed in claim 1, wherein forming each of the dampers comprises:

forming a hole having a predetermined depth connected to the second end of the respective pressure chamber, on the top of the intermediate substrate; and perforating the hole, thereby forming the damper connected to the second end of the respective pressure chamber.

18. The method as claimed in claim 17, wherein each of the dampers is formed to have a circular shape or a polygonal shape.

19. The method as claimed in claim 17, wherein the forming of the hole includes sand blasting, and the perforating the hole includes dry etching using inductively coupled plasma (ICP).

20. The method as claimed in claim 19, wherein before the sand blasting, laminating a dry film-shaped photoresist as a protecting layer for protecting another portion of the intermediate substrate on the intermediate substrate.

21. The method as claimed in claim 17, wherein the forming of the hole and the perforating the hole include dry etching using inductively coupled plasma (ICP).

22. The method as claimed in claim 17, wherein perforating the hole is performed simultaneously with forming the ink reservoirs.

23. The method as claimed in claim 1, wherein during the forming of the ink reservoirs, the top surface of the intermediate substrate is dry etched to a predetermined depth to form the ink reservoirs.

24. The method as claimed in claim 23, wherein during the forming of the ink reservoirs, in order to divide the ink reservoirs in a vertical direction, a barrier wall is formed in the ink reservoir in a lengthwise direction of the ink reservoirs.

25. The method as claimed in claim 23, wherein the ink reservoirs are formed through dry etching using inductively coupled plasma (ICP).

26. The method as claimed in claim 1, wherein forming each of the nozzles comprises:

etching the top surface of the lower substrate to a predetermined depth to form an ink induction part connected to the respective damper in flow communication; and etching the bottom surface of the lower substrate to form an orifice connected to the ink induction part in flow communication.

27. The method as claimed in claim 26, wherein during the forming of the ink induction part, anisotropically wet etching the lower substrate is using a silicon substrate having a crystalline face in a direction (100) as the lower substrate, thereby forming the ink induction part having a quadrangular pyramidal shape.

28. The method as claimed in claim 26, wherein the ink induction part is formed to have a conic shape.

29. The method as claimed in claim 1, wherein before the adhering of the substrates, stacking the three substrates using a mask aligner.

30. The method as claimed in claim 1, wherein during the adhering of the substrates, using a silicon direct bonding (SDB) method.

31. The method as claimed in claim 30, wherein during the adhering of the substrates, the three substrates are adhered to one another in a state where silicon oxide layers are formed at least on a bottom surface of the upper substrate and on a top surface of the lower substrate.

32. The method as claimed in claim 1 further comprising, before forming the piezoelectric actuators, forming a silicon oxide layer on the upper substrate.

33. The method as claimed in claim 1, wherein forming each of the piezoelectric actuators comprises:

sequentially stacking a titanium (Ti) layer and a platinum (Pt) layer on the upper substrate to form a lower electrode;

forming a piezoelectric layer on the lower electrode; and forming an upper electrode on the piezoelectric layer.

34. The method as claimed in claim 33, wherein during the forming of the piezoelectric layer, coating and then sintering a piezoelectric material in a paste state on the lower electrode in a position that corresponds to the respective pressure chamber, thereby forming the piezoelectric layer.

35. The method as claimed in claim 34, wherein the coating of the piezoelectric material includes screen-printing.

36. The method as claimed in claim 34, wherein, during sintering of the piezoelectric material, an oxide layer is formed on an inner wall of the ink passage formed on the three substrates.

37. The method as claimed in claim 33, wherein forming each of the piezoelectric actuators comprises:

after forming the upper electrode, dicing the adhered three substrates in units of a chip; and applying an electric field to the piezoelectric layer of the piezoelectric actuator to generate piezoelectric characteristics.

* * * * *